US005871893A

United States Patent [19]

Mitsuhashi

[11] Patent Number: 5,871,893

[45] Date of Patent: Feb. 16, 1999

[54] SILVER HALIDE PHOTOGRAPHIC LIGHT-SENSITIVE MATERIAL

[75] Inventor: Tsuyoshi Mitsuhashi, Hino, Japan

[73] Assignee: Konica Corporation, Japan

[21] Appl. No.: 900,998

[22] Filed: Jul. 25, 1997

[30] Foreign Application Priority Data

Aug. 6, 1996 [JP] Japan ..... 8-207185

[51] Int. Cl.[6] ..... G03C 1/35; G03C 1/85; G03C 5/16

[52] U.S. Cl. ..... 430/530; 430/527; 430/364; 430/542; 430/565; 430/965

[58] Field of Search ..... 430/364, 527, 430/530, 542, 565, 965

[56] References Cited

U.S. PATENT DOCUMENTS 4,022,617 5/1977 McGuckin ..... 430/203
4,865,958 9/1989 Abbott et al. ..... 430/542
5,372,923 12/1994 Kurachi et al. ..... 430/530
5,698,384 12/1997 Anderson et al. ..... 430/530

OTHER PUBLICATIONS

European Search Report EP 97 11 3440 (2 pages).
EPO Patent Abstracts of Japan Publication #03153234, Publication date: Jan. 7, 1991 (1 page).

*Primary Examiner*—Richard L. Schilling
*Attorney, Agent, or Firm*—Jordan B. Bierman; Bierman, Muserlian and Lucas

[57] ABSTRACT

A silver halide photographic light-sensitive material is disclosed. The light-sensitive material comprises a transparent support having thereon a hydrophilic colloid layer comprising a silver halide emulsion layer and an electric conductive layer, in which the electric conductive layer contains colloidal particles of a kind of metal oxide and at least one layer of the hydrophilic colloid layer contains a leucocompound of a blue dye.

9 Claims, No Drawings

SILVER HALIDE PHOTOGRAPHIC LIGHT-SENSITIVE MATERIAL

FIELD OF THE INVENTION

The present invention relates to a silver halide photographic light-sensitive material, hereinafter simply referred to a light-sensitive material, particularly relates to a silver halide photographic light-sensitive material excellent in an antistatic property and in a tone of silver image and inhibited in an unevenness of development.

BACKGROUND OF THE INVENTION

Recently, a time for access to an image is considerably shortened as a result of progress in electronics technology, and a rapidity of processing is increasingly demanded to a light-sensitive material. Consequently, many serious requirements are made on the light-sensitive material. Among them a requirement of anti-static property is particularly serious.

A high-molecular electrolyte or a surfactant has be usually used as an antistatic agent. These compounds, however, have a drawback that the developing solution is made turbid or a sludge is formed in the developing solution since the compounds are water-soluble and dissolved out into the developing solution at the time of processing.

Consequently, selection of a high-molecular electrolyte or a surfactant each having a high water solubility, or making cross-link the high-molecular electrolyte has been taken as the countermeasure for such the drawback.

However, it is required to reduce an amount of the waste liquid of a processing solution since an environmental regulation is made serious. The problems of the turbid and the sludge cannot be solved by the foregoing countermeasure when the processing is carried out with a reduced replenishing.

Japanese Patent (JP) No. 6-49894 discloses the use of an electric conductive layer comprised of water-insoluble crystalline metal oxide particles together with a hydrophobic binder such as polyvinylidene for avoiding such the problems. In this case, it is necessary to raise the filling ratio of the crystalline metal oxide particles to obtain a sufficient electric conductivity by the metal oxide because the hydrophobic binder is not electric conductive. In this publication, a filling ratio of not less than 80% is required. However, when the metal oxide particles are added in an amount of not less than 80%, the transparency of the processed film is lowered since the crystalline metal oxide particle scatters light.

As a countermeasure against such the problem, Japanese Patent Publication Open to Public Inspection (JP O.P.I.) No. 3-24656 discloses use of a hydrophilic binder and a nonionic surfactant having polyoxyethylene group together with the crystalline metal oxide. Moreover, JP O.P.I. No. 3-24957 proposes using a hydrophilic binder and a fluorinated surfactant.

However, the filling ratio of the metal oxide particles of not less than 50% is necessary for making a sufficient conductivity even when such the technique is applied. Consequently, the problem of turbid is not solved yet.

On the other hand, a tabular silver halide grain emulsion is well known as an emulsion having a high spectral sensitization efficiency and a high resolving power. However, the tabular silver halide grain has a drawback that the tone of a silver image formed from the tabular silver halide grains is yellowish black, not pure black tone, and the yellowish black ton image gives an unpleasant feeling to the observer in the case of a light-sensitive material for medical use. Such the phenomenon is often occurred in an emulsion of fine grains or that of the tabular grains having a small thickness, and a countermeasure using a toning agent has been disclosed.

However, the know toning agents (for example, a certain kind of mercapto compound) are hardly put practical use by the reason of that the application of the toning agent to a high-sensitive emulsion causes a considerable desensitization.

Recently, it is become essential to shorten the time for processing and drying for a ultra-rapid processing. For example, a rapid drying by a heating roller is applied.

The application of the ultra-rapid processing or rapid drying to the light-sensitive material causes an unevenness of development or drying, which results an unevenness of the glossiness of the surface of the light-sensitive material. The unevenness of the glossiness of the surface causes, together with the tone of silver image, considerable degradation of the image quality. Accordingly, further development has been demanded.

SUMMARY OF THE INVENTION

The object of the invention is to provide a silver halide photographic light-sensitive material which has a sufficient anti-static property and gives a pure black tone silver image without an unevenness of development.

The foregoing object is attained by a silver halide photographic light-sensitive material comprising a transparent support having thereon a hydrophilic colloid layer comprising a silver halide emulsion layer and an electric conductive layer, wherein said electric conductive layer contains colloidal particles of a kind of metal oxide and at least one layer of the hydrophilic colloid layer contains a leucocompound of a blue dye.

DETAILED DESCRIPTION OF THE INVENTION

The electric conductive metal oxide colloid comprises crystalline metal oxide particles which may contain an oxygen defect and/or a small amount of atom of another elemental forming a donor in the metal oxide particle.

The metal oxide colloid to be used in the electric conductive layer relating to the invention includes a colloid of oxide of metal such as zinc, magnesium, silicon, calcium, aluminum, strontium, barium, zirconium, titanium, manganese, iron, cobalt, nickel, tin, indium, molybdenum, or vanadium. Among them, ZnO, $TiO_2$ and $SnO_2$ are preferable and $SnO_2$ particularly preferable. Another kind of atom may be doped in the metal oxide. The example of the atom usable for doping includes Al or In to be doped in ZnO, Nb or Ta to be doped in $TiO_2$, and Sb, Nb or a halogen atom to be doped in $SnO_2$. The average diameter of the colloid particles is preferably 0.001 $\mu$m to 1 $\mu$m, from the viewpoint of the stability of dispersion.

The metal oxide colloid, particularly $SnO_2$ colloid sol composed of stannic oxide can be prepared by either a method by dispersing ultra-fine particles of $SnO_2$ in an appropriate solvent or a method utilizing a decomposition reaction of a solvent-soluble Sn compound in a solvent.

The thermal condition is particularly important regarding the preparation of the ultra-fine particles of $SnO_2$, and a method with a treatment at a high-temperature is not preferable since growth of primary particles and increasing in the crystallinity are occurred. When the thermal treatment is necessary, the treatment is preferably carried out at a temperature of not more than 300° C., more preferably not more than 200° C., particularly preferably not more than 150° C. The heating within the range of 25° C. to 150° C. is preferable from the viewpoint of dispersion of the particles in the binder.

When the miscibility of the solvent of the $SnO_2$ sol to the binder is low, it is necessary to change the solvent. In such the case, an appropriate amount of another compound having a high miscibility with the solvent or a high dispersion stability is added to the sol and the $SnO_2$ and the additional compound are separated and dried at a temperature of not more than 300° C., preferable not more than 200° C., more preferably not more than 150° C., and redispersed in another solvent.

The preparation method according to a decomposing reaction of a solvent-soluble Sn compound is described below.

The solvent-soluble Sn compound includes a compound containing an oxo-anion such as $K_2SnO_3 \cdot 3H_2O$, a water-soluble halogen compound such as $SnCl_4$, a compound having a structure of $R'_2SnR_2$, $R_3SnX$ or $R_2SnX_2$, in which R and R' are each an alkyl group and X is a halogen atom, such as $(CH_3)SnCl \cdot$pyridine, an organic metal compound such as $(C_4H_9)_2Sn(O_2CC_2H_5)_2$ and an oxo-salt such as $Sn(SO_4)_2 \cdot 2H_2O$.

The preparation method of $SnO_2$ sol using such the solvent-soluble Sn compound includes a method according to a physical treatment such as heating, pressure applying after dissolution in a solvent, a method utilizing a chemical treatment such as oxidation, reduction or hydrolysis after dissolution in a solvent and a method through an immediate compound. For example, a $SnO_2$ preparation method disclosed in JP No. 35-6616 is described below. $SnCl_4$ is dissolved in distilled water in an amount of 100 times in volume and stannic hydroxide is precipitated as an immediate compound. Ammonia water is added to the precipitate of stannic hydroxide to dissolved the precipitation and to make the weak alkaline solution. The solution is heated until smell of ammonia is removed, then a $SnO_2$ sol in a form of colloid is obtained. Although water is used as the solvent in the above example, an alcohol solvent such as methanol, ethanol or iso-propanol, an ether solvent such as tetrahydrofuran, dioxane or diethyl ether, an aliphatic organic solvent such as hexane or heptane, or an aromatic organic solvent such as benzene or pyridine, can be used according to the kind of Sn compound, and there is not limitation with respect to the solvent in the invention. Water and alcohol are preferred as the solvent.

In the preparation method according to the decomposition reaction of the Sn compound in the solvent, a compound containing an element other than Sn can be added in the course of the process. For example, a fluorine-containing compound soluble in the solvent or a solvent-soluble metal compound capable of taking a coordination number of 3 or 5, may be added.

The solvent-soluble fluorine-containing compound includes either an ionic fluorinated compound or a covalent bonded fluorinated compound. For example, HF, a metal fluoride such as KHF, $SbF_3$ or $MoF_6$, a compound capable of forming a fluoro-complex anion such as $NH_4MnF_3$ or $NH_4BiF_4$, an inorganic covalent bonded fluoride such as $BrF_3$, $SF_4$ or $SF_6$, and an organic fluoro-compound such as $CF_3I$, $CF_3COOH$ or $P(CF_3)_3$ can be cited. When water is used as the solvent, a combination of a fluorine-containing compound and a non-volatile acid such as that of $CaF_2$ and sulfuric acid can be used.

The compound of the metal capable of taking a coordination number of 3 or 5 includes a compound of an element of Group IIIb of the periodical table such as Al, Ga, In or Tl, that of an element of Group V such as P, As, Sb or Bi, and that of a transition metal capable of taking a coordination number of 3 or 5 such as Nb, V, Ti, Cr, Mo, Fe, Co or Ni.

A binder usable as the binder of the electric conductive layer includes a protein such as gelatin, a gelatin derivative, colloidal albumin or casein, a cellulose compound such as carboxymethyl cellulose, hydroxyethyl cellulose, diacetyl cellulose or triacetyl cellulose, a sugar derivative such as agar, sodium arginate or a starch derivative, a synthetic hydrophilic colloid such as polyvinyl alcohol, poly-N-vinylpyrrolidone, a copolymer of polyacrylic acid, polyacrylamide or derivative or partially hydrolized compound thereof, a vinyl polymer or copolymer such as polyvinyl acetate or polyacrylate, a natural substance or a derivative thereof such as rosin or shellac, and various kinds of synthetic polymer. Moreover, an aqueous emulsion of a styrene-butadiene copolymer, polyacrylic acid, polyacrylate or a derivative thereof, polyvinyl acetate, a copolymer of vinyl acetate and acrylate, polyolefin, an olefin/vinyl acetate copolymer can be used. An organic semi-conductor such as polycarbonate-type, polyester-type, urethane-type, epoxy-type resin, polyvinyl chloride or polypyrrole can also be used. Two or more kinds of these binders may be used as a mixture.

Among these binders, a copolymer of polyacrylic acid, polyacrylamide, polyacrylonitryl, polyacrylate, polycarbonate, polyester, polyvinyl chloride and polyvinylidene chloride are preferred from the viewpoint of easy handling in the preparation process and the property of the product.

The resistivity of the electric conductive layer can easily be adjusted to 10 to $10^{10}\Omega \cdot cm$ by controlling the volumetric content of the conductive particles in the electric conductive layer and/or the thickness of the electric conductive layer. It is preferred, however, that the amount of the binder is not less than 5% by weight to keep the sufficient strength of the electric conductive layer. The ratio of the electric conductive particles is preferably 10 to 70%, more preferably 15 to 50%, in volumetric content, and the using amount is preferably 0.05 to 5.0 $g/m^2$, more preferably 0.1 to 2.0 $g/m^2$.

A dispersion of the foregoing composition is prepared by using an appropriate solvent at the time of coating the electric conductive layer. The solvent can be easily selected. A coating method can be optionally selected from know methods without any limitation. A known coating aid such as saponine or dodecylbenzenesulfonic acid, a hardener, a UV-absorbent, a heat-ray cutting agent can be optionally added to the coating liquid according to necessity. A subbing layer may be provided on the support for raising the adhesiveness between the support and the layer coated thereon.

In the silver halide photographic light-sensitive material of the invention, the electric conductive layer may be arranged at any portion in the photographic constituent layers. It is preferable to arrange the electric conductive layer on the subbing layer provided on the support for enhancing the effect of the invention.

In the hydrophilic colloid layer, at least one kind of leucocompound. The leucocompound is the leucocompound of a blue dye, which is capable of forming a blue dye proportionally to silver image upon reaction of the oxidation product of a developing agent formed in the developing process. The blue dy thus formed makes the tone of silver image to neutral black.

The concrete example of the leucocompound includes the leuco compound of an indoaniline dye, the leucocompound of an indamine dye, the leucocompound of a triphenylmethane dye, the leucocompound of a triarylmethane dye, the leucocompound of a styryl dye, the leucocompound of an N-acyloxazine dye, the leucocompound of an N-acylthiazine dye and the leucocompound of a xantene dye.

The leucocompound preferably usable in the inbention includes one represented by the following Formula 1, 2, 3 or 4.

Formula 1

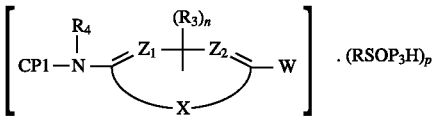

In the formula, W is —$NR_1R_2$, —OH or —OZ, in which $R_1$ and $R_2$ are each an alkyl group or an aryl group, and Z is an alkali metal ion or a quaternary ammonium ion. $R_3$ is a hydrogen atom, a halogenatom or a monovalent substituent, and n is an integer of 1 to 3. $Z_1$ and $Z_2$ are each a nitrogen atom or =C($R_3$)—. X is a group of atoms necessary for forming a 5- or 6-member aromatic heterocyclic ring together with $Z_1$, $Z_2$ and the carbon atoms each adjoining with $Z_1$ and $Z_2$, respectively. $R_4$ is a hydrogen atom, an acyl group, a sulfonyl group, a carbamoyl group, a sulfo group, a sulfamoyl group, an alkoxycarbonyl group, or an aryloxycarbonyl group. R is an aliphatic group or an aromatic group; p is an integer of 0 to 2; and CP1 is a group selected from the groups described below.

CP1

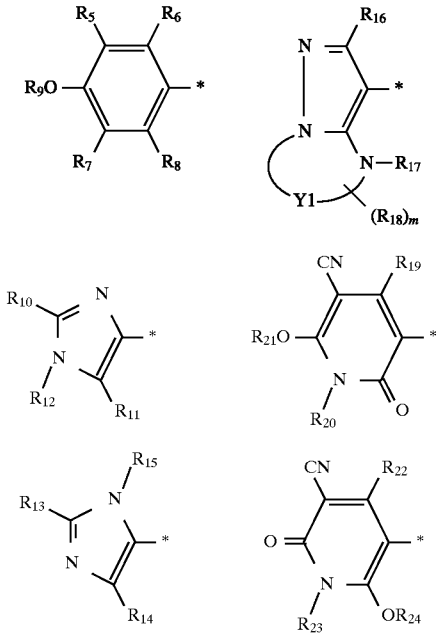

-continued

CP1

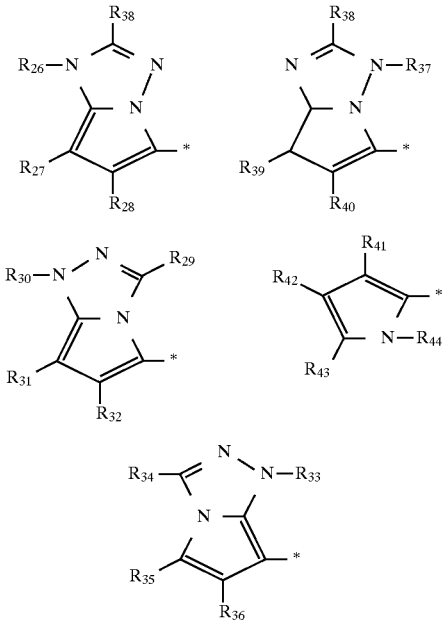

In the formulas above-mentioned, $R_5$ through $R_8$ are each a hydrogen atom, a halogen atom or a group capable of being a substituent of the benzene ring. $R_5$ and $R_6$, or $R_7$ and $R_8$ may form a ring by bonding with together. $R_9$ is synonymous with $R_4$. $R_{10}$ and $R_{11}$ are each an alkyl group, an aryl group or a heterocyclic group. $R_{12}$ is the synonymous with $R_4$. $R_{13}$ and $R_{14}$ are synonymous with $R_{10}$ and $R_{11}$. $R_{15}$ is synonymous with $R_{12}$. $R_{16}$ is an alkyl group, an aryl group, a sulfonyl group, a carboxyl group, an aryloxycarbonyl group, an alkoxycarbonyl group, a carbonyl group or a cyano group. $R_{17}$ is synonymous with $R_4$. $R_{18}$ is synonymous with $R_3$. m is an integer of 1 to 3. Y1 is a group of atoms necessary to form a single or condensed nitrogen containing 5- or 6-member heterocyclic ring together with the two nitrogen atoms. $R_{19}$ and $R_{20}$ are each an alkyl group or an aryl group. $R_{21}$ is synonymous with $R_4$. $R_{22}$ arid $_{23}$ are synonymous with $R_{19}$ and $R_{20}$. $R_{24}$ is synonymous with $R_{21}$. $R_{25}$, $R_{27}$ and $R_{28}$ are each a hydrogen atom or a substituent. $R_{26}$ is synonymous with $R_4$. $R_{29}$, $R_{31}$ and $R_{32}$ are synonymous with $R_{25}$, $R_{27}$ and $R_{28}$. $R_{30}$ is synonymous with $R_{26}$. $R_{30}$ is synonymous with $R_{26}$. $R_{34}$, $R_{35}$ and $R_{36}$ are synonymous with $R_{25}$, $R_{27}$ and $R_{28}$. $R_{33}$ is synonymous with $R_{26}$. $R_{38}$, $R_{35}$ and $R_{40}$ are synonymous with $R_{25}$, $R_{27}$ and $R_{28}$. $R_{37}$ is synonymous with $R_{26}$. $R_{38}$, $R_{41}$, $R_{42}$ and $R_{43}$ are synonymous with $R_{25}$, $R_{27}$ and $R_{28}$. R44 is synonymous with $R_{26}$. ★ represents a position of CP1 bonding with the other part of the compound of Formula 1.

The compound represented by Formula may preferably be a compound represented by the following Formula 2.

Formula 2

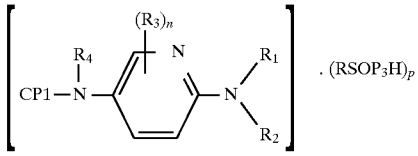

In the above formula, $R_1$, $R_2$, $R_3$, $R_4$, CP1, n, R and p are each synonymous with $R_1$, $R_2$, $R_{31}$ $R_4$, CP1, n, R and p in Formula 1, respectively.

In the compound represented by Formula 1 or Formula 2, at least one of groups represented by $R_4$, $R_9$, $R_{12}$, $R_{15}$, $R_{17}$, $R_{21}$, $R_{24}$, $R_{26}$, $R_{30}$, $R_{33}$, $R_{37}$, and $R_{44}$ may be substituted by $-COOM^1$ or $—SO_3M^2$, in which $M^1$ and $M^2$ are each a hydrogen atom or an alkali metal atom.

In Formula 1 or 2, a preferable examples of the alkyl group represented by $R_1$ or $R_2$ includes a methyl group, an ethyl group, and a butyl group. These alkyl groups each may preferably have a substituent and the preferable substituents includes a hydroxyl group and a sulfonamide group.

The example of the monovalent substituent represented by $R_3$ includes an alkyl group such as a methyl group, ethyl group, iso-propyl group, hydroxyethyl group, methoxymethyl group, trifluoromethyl group, and t-butyl group; an cycloalkyl group such as a cycropentyl group and cyclohexyl group; an aralkyl group such as a benzyl group and 2 phenetyl group; an aryl group such as a phenyl group, naphthyl group, p-tolyl group and p-chlorophenyl group; an alkoxyl group such as a methoxy group, ethoxy group, iso-propoxy group an n-butoxy; an aryloxy group such as a phenoxy group; a cyano group; an acylamino group such as an acetylamino group and porpionylamino group; an alkylthio group such as a methylthio group, ethylthio group and n-butylthio group; an arylthio group such as a phenylthio group; a sulfonylamino group such as a methanesulfonylamino group and benzenesulfonylamino group; a ureido group such as a 3-methylureido group, 3,3-dimethylureido group and 1,3-dimethylureido group; a sulfamoylamino group such as a dimethylsulfamoylamino group; a carbamoyl group such as a methylcarbamoyl group, ethylcarbamoyl group and dimethylcarbamoyl group; a sulfamoyl such as a ethylaulfamoyl group and dimethylsulfamoyl group; an alkoxycarbonyl group such as an aryloxycarbonyl group such as a phenoxycarbonyl group; a sulfonyl group such as a methanesulfonyl group, butanesulfonyl group and phenylsulfonyl group; an acyl group such as an acetyl group, propanoyl group and butyloyl group; an amino group such as a methylamino group, ethylamino group and dimethylamino group; a hydroxyl group; a nitro group; an imido group such as a phthalimido group; a heterocyclic group such as a pyridyl, benzimidazolyl group, benzothiazolyl group and benzoxazolyl group.

The acyl group represented by $R_4$ is preferably an acetyl group, a trifluoroacetyl group and a benzoyl group. The sulfonyl group is preferably a methane sulfonyl group or benzenesulfonyl group. The carbamoyl group is preferably a diethylcarbamoyl group or phenylcarbamoyl group. The sulfamoyl group is preferably a diethylsulfamoyl group. The alkoxycarbonyl group is preferably a methoxycarbonyl group or ethoxycarbonyl group. The aryloxycarbonyl group is preferably a phenoxycarbonyl group.

The alkali metal atom represented by Z includes a sodium atom or a potassium atom. The quaternary ammonium includes an ammonium having 8 or more carbon atoms such as trimethyl-benzylammonium, tetrabutylammonium and tetradecylammonium The 5- Or 6-member heterocyclic group formed by X, $Z_1$, $Z_2$ and the carbon atoms each adjoining with $Z_1$ and $Z_2$, respectively includes a pyridine ring, a prymidine ring, a prydazine ring, a pyrazine ring, a triazine ring, a tetrazine ring, a pyrrole ring, a furan ring, a thiophene ring, a thiazole ring, an oxazole ring, an imidazole ring, a thiadiazole ring and an oxadiazole ring. The pyridine ring is preferable.

The substituent represented by $R_5$ to $R_7$ or $R_8$ capable of being a substitutent of the benzene ring includes the foregoing monovalent substituents represented by $R_3$. Preferable one is an alkyl group and an acylamino group.

The 5- to 7-member heterocyclic ring formed by bonding $R_5$ with $R_6$ or $R_7$ with $R_8$ includes an aromatic carbon ring and an a heterocyclic ring, and a benzene ring is preferred.

The alkyl group represented by $R_{10}$ or $R_{11}$ includes a methyl group, ethyl group, a propyl group and butyl group. The aryl group represented by $R_{10}$ or $R_{11}$ includes a phenyl group and naphthyl group. The heterocyclic group represented by $R_{10}$ or $R_{11}$ includes a 5- or 6-member aromatic heterocyclic ring having at least one of O, S and N atoms in the ring thereof, for example a six-member azine such as a pyridine group, pyrazine group, pyrimidine group and a benzelogue thereof; a pyrrole group thiophene group, furan group and a benzelogeu thereof, a five-member azoles such as an imidazole group, triazole group, tetrazole group, thiazole group, oxazole group, thiadiazole group, oxadiazole group and benzeloge thereof. Preferably group represented by $R_{10}$or $R_{11}$includes a phenyl group, a pyrazolyl group and a pyridiyl group.

An example of the alkyl group represented by $R_{16}$ includes a methyl group, iso-propyl group, pentyl group, t-butyl group. The alkyl group represented by $R_{16}$ may be one having a substituent such as trifluoromethyl group. An example of the aryl group includes a phenyl group and a naphthyl group An example of the sulfonyl group includes a methinesulfonyl group and a benzenesulfonyl group. An example of the aryloxycarbonyl group includes a phenoxycarbonyl group. An examples of the alkoxycarbonyl group includes an ethoxycarbonyl group, and an example of the carbamoyl group includes a diethylaminocarbamoyl group.

A example of the nitrogen-containing heterocyclic group represented by Yl includes an imidazole ring, a triazole ring a tetrazole ring and a benzelogue thereof.

An example of the alkyl group represented by $R_{19}$ or $R_{20}$ includes a methyl group, pentyl group, and t-butyl group. and that of the ethyl group includes a phenyl group and anaphthyl group.

An example of the substituent represented by $R_{25}$, $R_{27}$ or $R_{28}$ includes a phenyl group, a methyl group, a benzoyl group a phenoxy group and an ethoxy group.

An example of the aliphatic group represented by R includes a hexyl group and a dodecyl group, and that of the aromatic group includes a p-tolyl group and a dodecylphenyl group.

Examples of the compounds represented by Formula 1 or 2 are listed below. In the followings, CP represents the moiety of the compound represented by CPI in the formulas, and CD represents the moiety of the compound other than the moieties of CP1 and $RSO_3H$ in the formula. $RSO_3H$ represents the moiety of $RSO_3H$ in the formula.

CP
CP-1
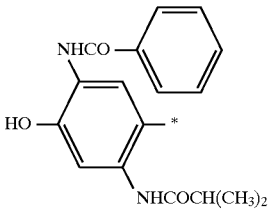
CP-2
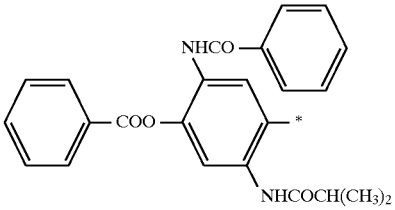
CP-3
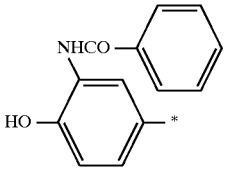
CP-4
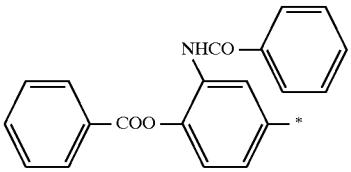
CP-5
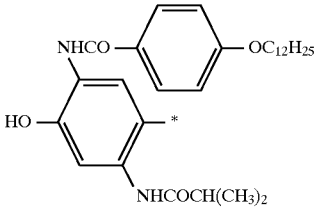
CP-6
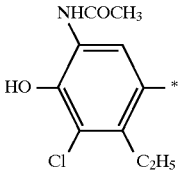
CP-7
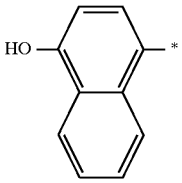
CP-8
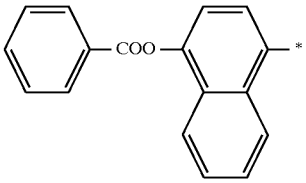

-continued
CP-9
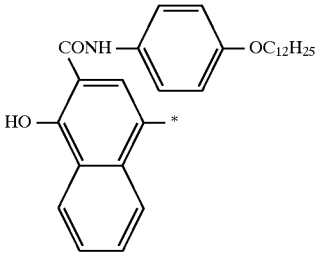
CP-10
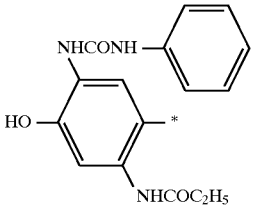
CP-11
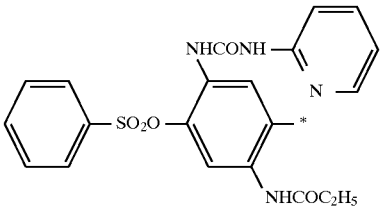
CP-12
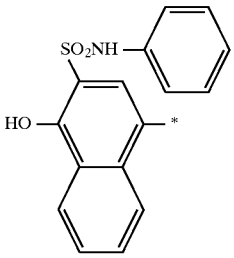
CP-13
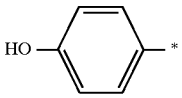
CP-14
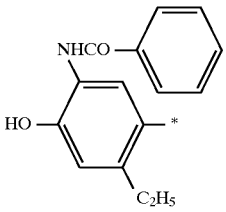
CP-15
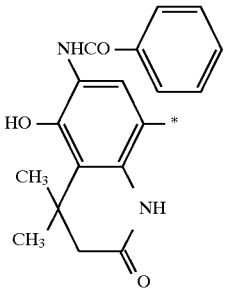

-continued
CP-16
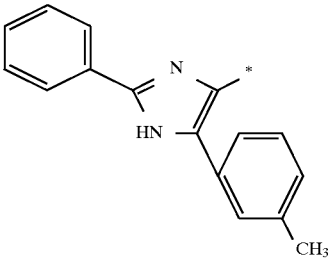
CP-17
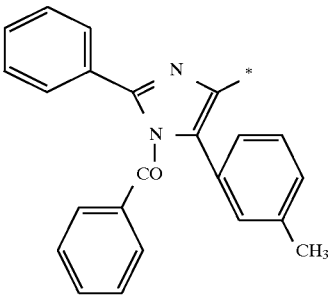
CP-18
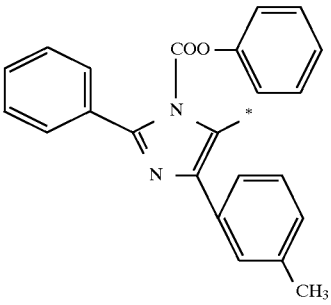
CP-19
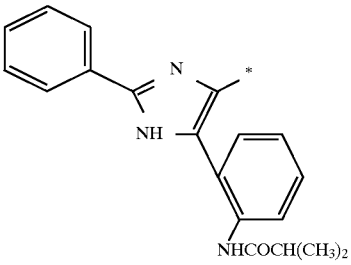
CP-20
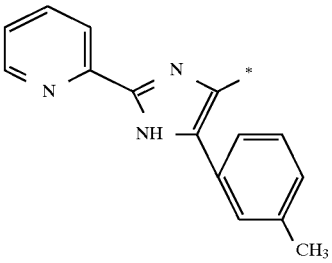
CP-21
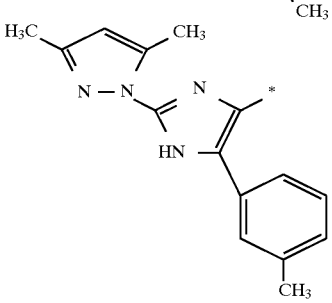

-continued
CP-22
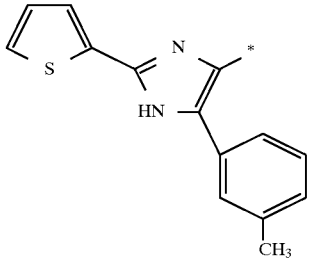
CP-23
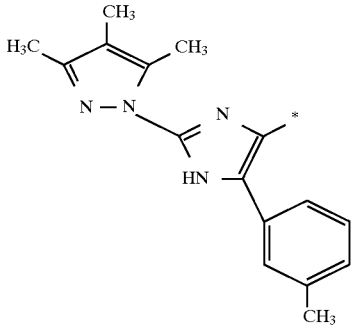
CP-24
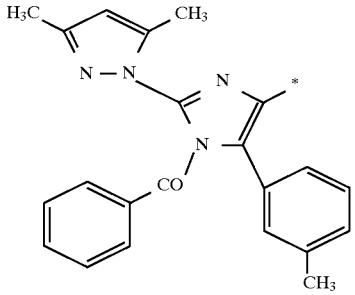
CP-25
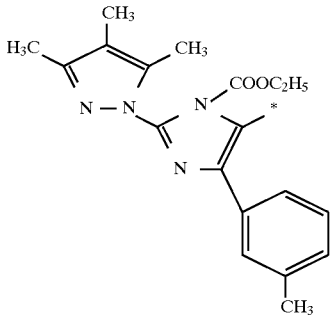
CP-26
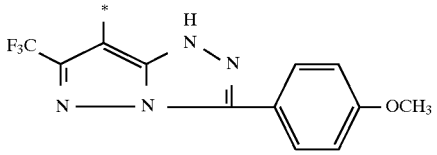
CP-27
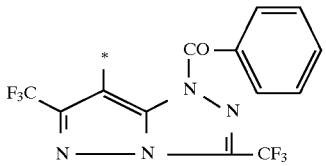

-continued
CP-28
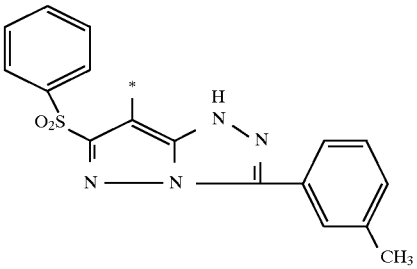
CP-29
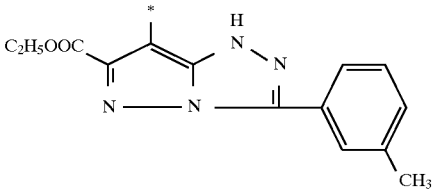
CP-30
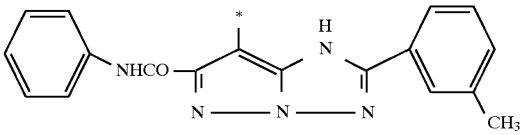
CP-31
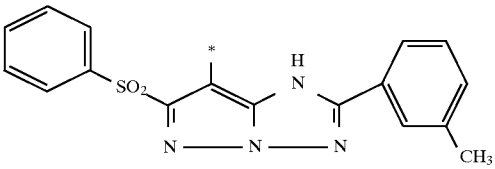
CP-32
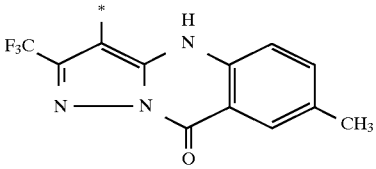
CP-33
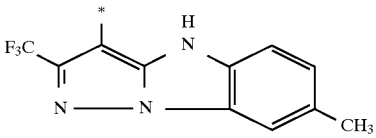
CP-34
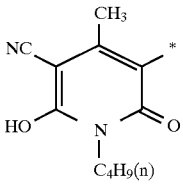
CP-35
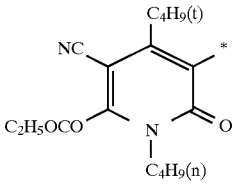

-continued
CP-36
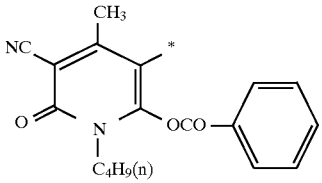
CP-37
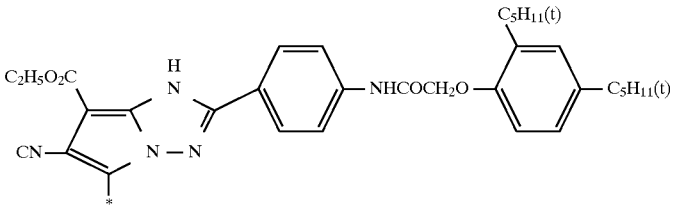
CP-38
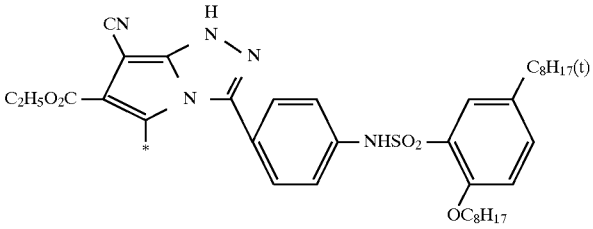
CP-39
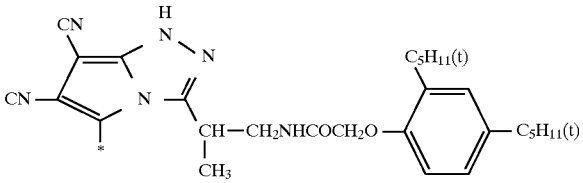
CP-40
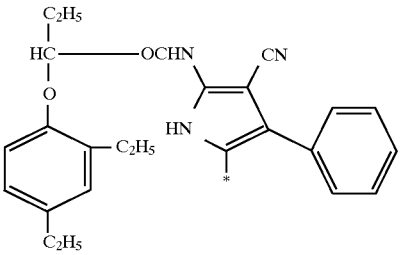
CP-41
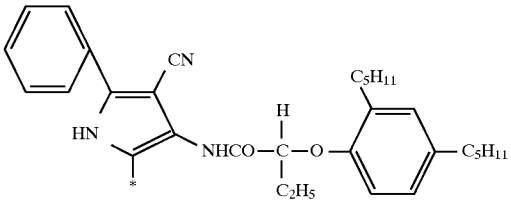
CP-42
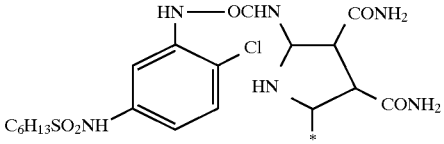

-continued
CP-43
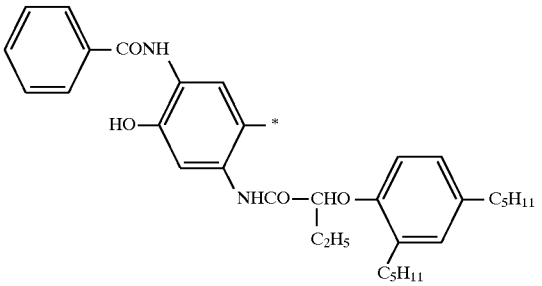
CP-44
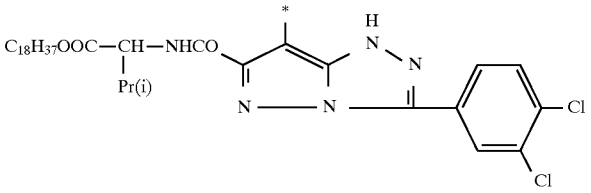
CD
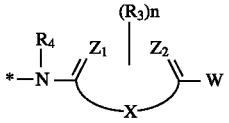
CD-1
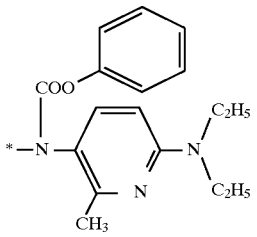
CD-2
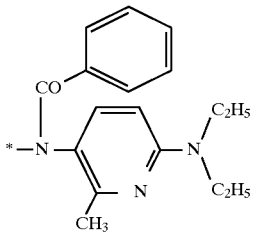
CD-3
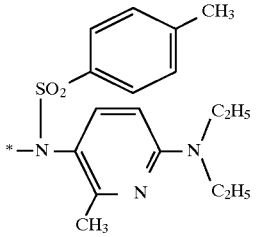
CD-4
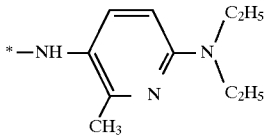

-continued
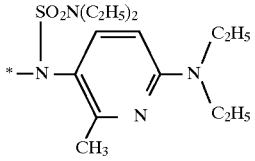
CD-5
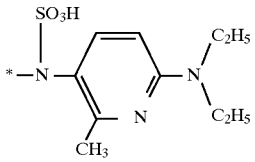
CD-6
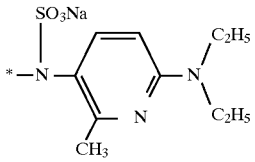
CD-7
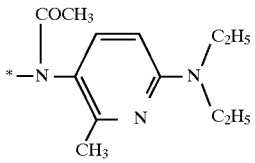
CD-8
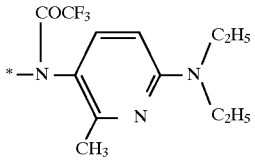
CD-9
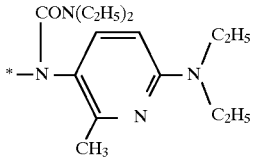
CD-10
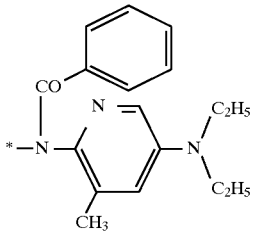
CD-11
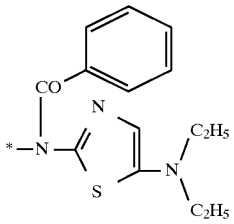
CD-12
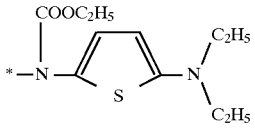
CD-13

-continued
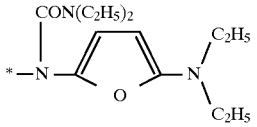
CD-14
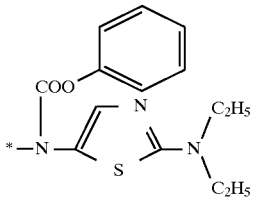
CD-15
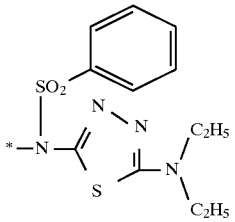
CD-16
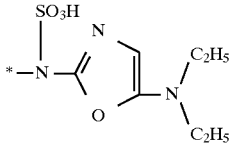
CD-17
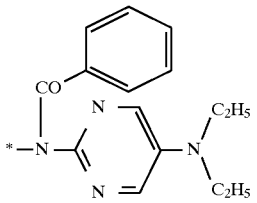
CD-18
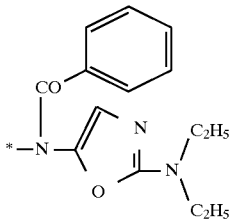
CD-19
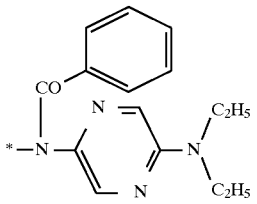
CD-20
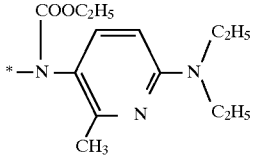
CD-21

-continued
CD-22
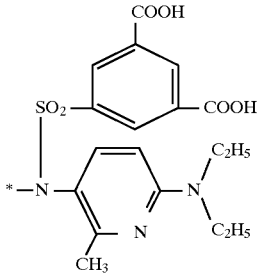
CD-23
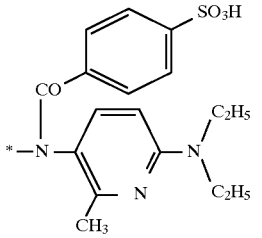
CD-24
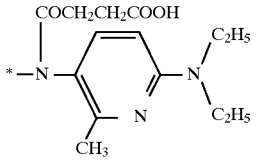
CD-25
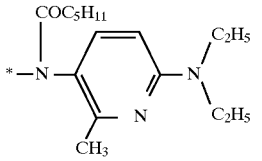
CD-26
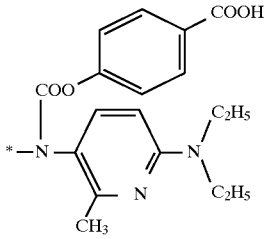
CD-27
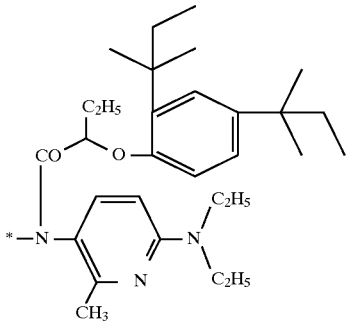
CD-28
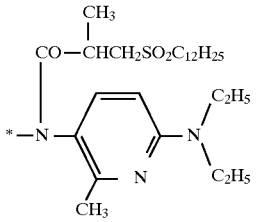

-continued
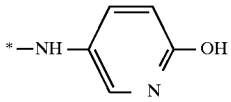
CD-29
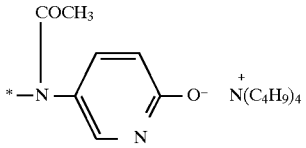
CD-30
$RSO_3H$
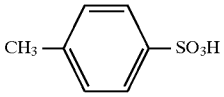
a)
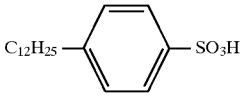
b)
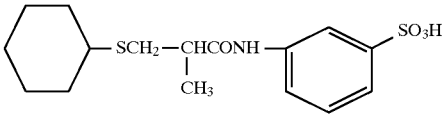
c)
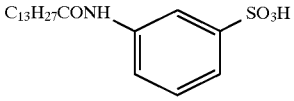
d)
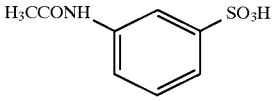
e)
$C_{12}H_{25}SO_3H$
f)
| No. | CP | CD | $RSO_3H$ |
|---|---|---|---|
| 1 | 1 | 1 | |
| 2 | 1 | 2 | |
| 3 | 1 | 3 | |
| 4 | 1 | 4 | |
| 5 | 1 | 5 | |
| 6 | 1 | 6 | |
| 7 | 1 | 7 | |
| 8 | 1 | 8 | |
| 9 | 1 | 9 | |
| 10 | 1 | 10 | |
| 11 | 1 | 21 | |
| 12 | 1 | 25 | |
| 13 | 2 | 2 | |
| 14 | 2 | 7 | |
| 15 | 2 | 15 | |
| 16 | 2 | 20 | |
| 17 | 3 | 1 | |
| 18 | 3 | 2 | |
| 19 | 3 | 8 | |
| 20 | 4 | 16 | |
| 21 | 4 | 22 | |
| 22 | 5 | 1 | |
| 23 | 5 | 7 | |
| 24 | 5 | 11 | |
| 25 | 5 | 27 | |
| 26 | 7 | 1 | |
| 27 | 7 | 2 | |
| 28 | 8 | 9 | |
| 29 | 8 | 12 | |
-continued
| No. | CP | CD | $RSO_3H$ |
|---|---|---|---|
| 30 | 16 | 2 | |
| 31 | 16 | 7 | |
| 32 | 17 | 10 | |
| 33 | 18 | 13 | |
| 34 | 21 | 1 | |
| 35 | 21 | 4 | |
| 36 | 21 | 7 | |
| 37 | 21 | 18 | |
| 38 | 26 | 2 | |
| 39 | 26 | 7 | |
| 40 | 26 | 15 | |
| 41 | 26 | 19 | |
| 42 | 33 | 2 | |
| 43 | 33 | 10 | |
| 44 | 33 | 14 | |
| 45 | 33 | 16 | |
| 46 | 34 | 2 | |
| 47 | 34 | 5 | |
| 48 | 35 | 17 | |
| 49 | 35 | 21 | |
| 50 | 36 | 3 | |
| 51 | 37 | 1 | |
| 52 | 37 | 4 | |
| 53 | 38 | 30 | |
| 54 | 40 | 2 | |
| 55 | 42 | 8 | |
| 56 | 1 | 1 | b |
| 57 | 1 | 4 | a |
| 58 | 1 | 8 | c |

-continued

| No. | CP | CD | $RSO_3H$ |
|---|---|---|---|
| 59 | 1 | 8 | a |
| 60 | 1 | 9 | b |
| 61 | 2 | 13 | a |
| 62 | 2 | 19 | c |
| 63 | 11 | 1 | b |
| 64 | 17 | 9 | d |
| 65 | 20 | 24 | a |
| 66 | 23 | 4 | e |
| 67 | 26 | 28 | c |
| 68 | 33 | 8 | b |
| 69 | 36 | 3 | a |
| 70 | 39 | 2 | c |
| 71 | 41 | 1 | e |
| 72 | 41 | 4 | b |
| 73 | 42 | 28 | a |
| 74 | 43 | 8 | |
| 75 | 43 | 9 | |
| 76 | 43 | 4 | a |
| 77 | 44 | 8 | |
| 78 | 44 | 9 | |
| 79 | 44 | 4 | a |

Synthetic example 1: Synthesis of exemplified compound 8

Procedure of the Synthesis

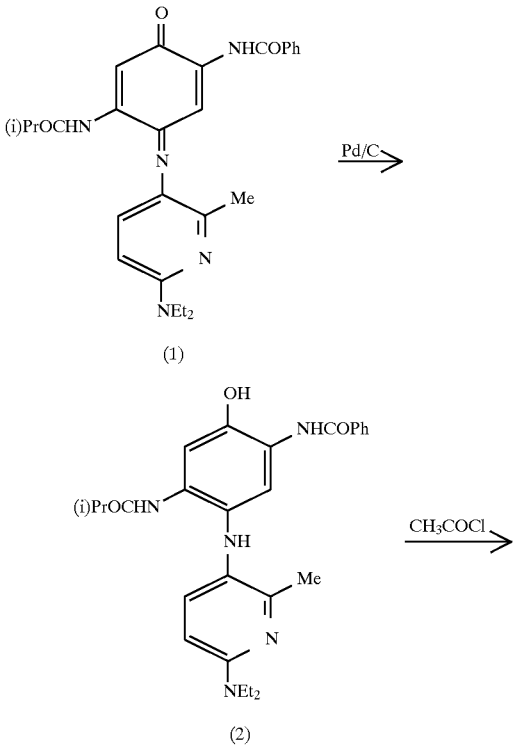

-continued

Procedure of the Synthesis

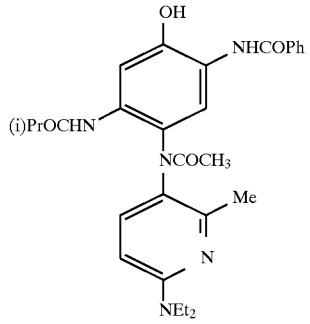

Exemplified compound 8

In 50 ml of ethyl acetate, 3.9 g of the above compound 1 was dissolved and ctalitic hydrogenated after addition of 0.5 g of 5% Pd/C under an ordinary pressure. Blue color of the reaction liquid was decolored and Compound 2 was formed.

To the reaction liquid, 1.2 g of triethylamine and 1.5 g of acetylchloride was added and the liquid was stirred for 2 hours at a room temperature. The catalizer and an insluble matter were filtered and the remainder was recrystalized using ethyl acetate, thus 3.8 g of Exemplified Compound 8 was obtained with a yield of 89%.

The chemical structure of the compound was confirmed by the NMR spectrum and the mass spectrum thereof.

Synthetic example 2: Synthesis of Exemplified compound 9

Synthetic procedure

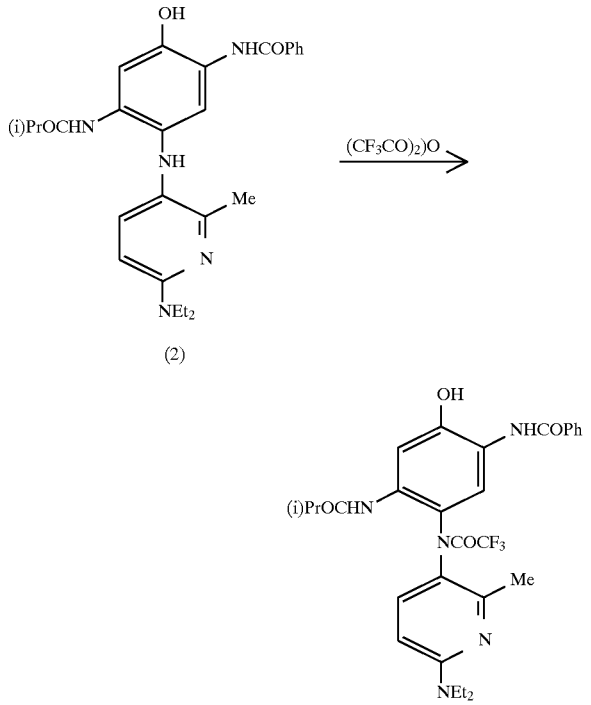

Exemplified compound 9

In 50 ml of ethyl acetate, 3.9 g of Compound 1 described in Synthetic example 1 was dissolved and ctalitic hydrogenated after addition of 0.5 g of 5% Pd/C under an ordinary pressure. Blue color of the reaction liquid was decolored and Compound 2 was formed.

Then, 1.2 g o triethylamine and 4.0 g of anhydrous trifluoroacetic acid was added to the reaction liquid and the liquid was stirred for 2 hours. The catalizer and an insluble matter were filtered and the remainder was recrystalized using ethyl acetate, thus 4.0 g of Exemplified Compound 9 was obtained with a yield of 85%.

The chemical structure of the compound was confirmed by the NMR spectrum and the mass spectrum thereof.

Synthetic example 3: Synthesis of Exemplified compound 58

Procedure of the Synthesis

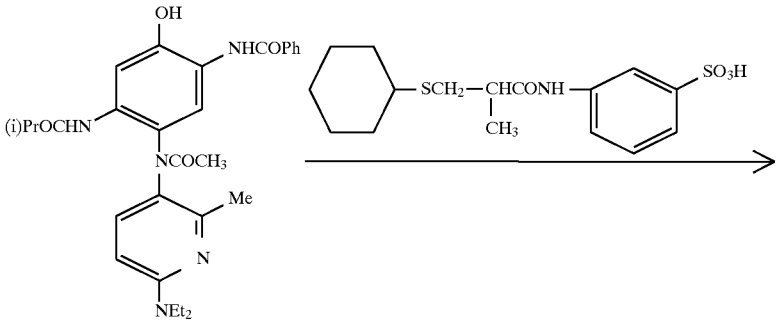

Exemplified compound 8

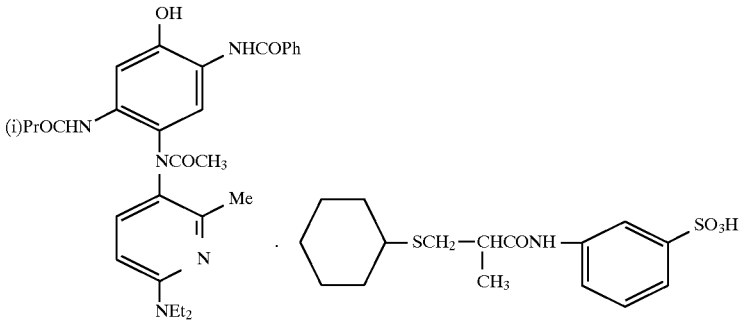

Exemplified compound 58

In 30 ml of methanol, 3.5 g of Exemplified compound 8 was dissolved and the liquid was stirred after addition of 2.6 g of monohydrous p-toluenesulfonic acid.

The reaction liquid was put into 300 ml of water. Then Exemplified Compound 58 was recipitated. The precipitate was of filtered. Thus 4.1 g of objective compound was obtained with a yield of 87%.

The chemical structure of the compound was confirmed by the NMR spectrum and the mass spectrum thereof.

The leucocompounds other than the above can be easily sythesized in a manner similar to the above-mentioned.

When the leucocompound represented by Formula 1 or 2 in which p is 0 is used, it is preferred to separately add a compound represented by $RSO_3H$, R is the same as that defined in Foemula 1. In such the case, the amount of the compound represented by $RSO_3H$ is 1 to 3 moles per mole of the leucocompound.

The leucocompound represented by Formula 1 or 2 is a compound capable of forming a blue dye upon reaction with the oxidation product of a developing agent. The amount of the leucocompound to be contained to the light-sensitive material is preferably $1\times10^{-5}$ moles to $5\times10^{-1}$ per mole of silver halide contained in the light-sensitive material.

The contained amount of the leucocompound is more preferably $5\times10^{5}$ to $5\times10^{-2}$ moles, further preferably $5\times10^{-4}$ moles to $1\times10^{-2}$ moles per mole of silver halide.

For adding the leucocompound, various methods can optionally be applied depending on the properties of the compound. The method includes, for example, a method in which the leucocompound is added in a form of dispersion of solid particles, in a form of emulsified dispersion of a solution of a high-boiling solvent, or in a form of solution in a water-miscible organic solvent such as methanol, ethanol or acetone.

The adding amount of the leucocompound is preferably 5 to 300 $mg/m^2$, more preferably 10 to 100 $mg/m^2$, when the leucocompound is added into a hydrophilic colloid layer of the silver halide photographic light-sensitive material.

The leucocompound is added into a hydrophilic colloid layer such as the silver halide emulsion layer, a protective layer adjacent to the emulsion layer, an interlayer, a dyed layer or the anti-static layer. It is preferable to add the leucocompound into the silver halide emulsion layer.

It is preferred to use water or a water-miscible solvent which gives no bad effect on the photographic properties such as an alcohol, an ether, a ketone, an ester or an amide, for adding the leucocompound.

The leucocompound may be added directly in a form of the foregoing solution, or by a method usually using for adding a coupler for color photography to a hydrophilic colloid layer, for example, the leucocompound is dissolved in an organic solvent and dispersed with a surfactant and thus obtained dispersion is added to a hydrophilic colloid. In such the case, a high boiling-solvent having a boiling point not less than 175° C. and a low-boiling solvent having a boiling point of 30° C. to 150° C. may be used singly or in combination.

As the high-boiling solvent, di-n-butyl phthalate, benzyl phthalate, triphenyl phthalate, tri-o-cresyl phosphate, diphenylmono-p-tert-butylphenyl phosphate, monophenyldi-p-tert-butylphenyl phosphate, 2,4-di-tert-amylphenol, N,N-diethyllaurylamideand trihexyl phosphate are usable. The foregoing water miscible solvent can be used as the low-boiling solvent.

The leucocompound can be added in a form of dispersion of solid particles.

The leucocompound may be added to the hydrophilic colloid solution at a any process of the preparation of the light-sensitive material. It is preferable to add the leucocompound at a time before the coating process, particularly at the time of coating liquid preparation.

The coating amount of silver of the light-sensitive silver halide emulsion layer is 0.5 to 1.5 g/m$^2$, preferably 0.7 to 1.5 g/m$^2$, per side of the light-sensitive material.

In the light-sensitive material of the invention, the gelatin amount in the light-sensitive silver halide emulsion layer per side of the light-sensitive material is 10 to 40%, preferably 15 to 35%, by weight of the total amount of the binder contained in all the hydrophilic layers coated on the side of light-sensitive material. In concrete, the amount of gelatin in the emulsion layer per side is 0.5 to 2.5 g/m$^2$, preferably 1.0 to 2.5 g/m$^2$. Here, the all hydrophilic colloid layers includes the light-sensitive silver halide emulsion layer, a protective layer, interlayer, dyed layer, subbing layer and anti-static layer.

In the case of a light-sensitive material having silver halide emulsion layer on both sides of the support, the above-mentioned amounts of silver and gelatin are coated on each of the sides of the support to prepare a light-sensitive material for X-ray photography.

Gelatin and a gelatin derivative are advantageously used as the binder in the light-sensitive material of the invention. As gelatin, lime processed gelatin and acid-processed gelatin such as those described in Bull. Soc. Sci. Phot. Japan, No. 16, p. 30 (1966) are usable. A hydrolyzed product or a enzyme decomposed product of gelatin can also be used. As the gelatin derivative, a product of gelatin reacted with a compound, for example, an acid halide, an acid anhydrous, an isocyanate, a bromoacetoalkanesultone, a vinylsulfonamide, a maleinimide, a polyalkyleneoxide or an epoxy compound is usable.

A silver bromide emulsion, a silver iodobromide emulsion, or a silver iodochlorobromide emulsion containing a small amount of silver chloride may be used as the light-sensitive silver halide emulsion of the light-sensitive material of the invention. The silver halide grain may be one having any crystal shape, for example, a cubic, octahedral or tetradecahedral single crystal, or a poly-twinned crystal having various shapes.

The silver halide grain can be prepared under a solution condition such as an acidic method, an ammoniacal method or a neutral method and a mixing condition such as a regular mixing method, a reverse mixing method, a double-jet mixing method or a controlled double-jet mixing method, and a grain forming condition such as a conversion method or core/shell method and a combination of these conditions.

An emulsion comprised of monodispersed silver halide grains in each of which silver iodide is localized inside the grain is a preferably used in the light-sensitive material of the invention. The monodispersed emulsion is a emulsion in which at least 95% in number of grains are within ±40%, preferably ±30%, of the average grain diameter when the average diameter is determined by an ordinary method.

With respect to the grain diameter distribution of the silver halide grains, a monodispersed emulsion having narrow grain diameter distribution or a polydispersed emulsion having a wide grain diameter distribution may also be usable. The crystal structure of the silver halide grain may be one in which the internal portion and the external portion of the grain are different from each other in the silver halide composition, for example, a core/shell type monodispersed grains each composed of a core having a high silver iodide content and a shell having a low silver iodide content which covers the core so as to make a distinct double layer structure.

In the light-sensitive material of the invention, a monodispersed emulsion may be used which prepared by growing seed brains by supplying silver ions and halide ions.

The silver halide emulsion used in the light-sensitive material of the invention may be one comprised of silver halide grains having an aspect ratio, ratio of grain diameter/grain thickness, of not less than 3. Grain having an aspect ratio of not less than 4 is preferred. British Patent No. 2,112,157 and U.S. Pat. Nos. 4,414,310 and 4,434,226 disclose that advantages such as improving in the efficiency of spectral sensitization, graininess and sharpness of image, can be obtained by using such the tabular grain. The emulsion can be prepared referring the methods described in these publications.

The above-mentioned emulsion may be any of a surface image forming type emulsion forming a latent image on the surface of the grain, a internal image forming type emulsion forming a latent image at an internal portion of the grain and an emulsion forming a latent image at the surface and the internal portion of the grain.

A cadmium salt, lead salt, thallium salt, iridium salt or its complex, rhodium salt or its complex, or iron salt or its salt can be used at the step of physical ripening or grain formation of the emulsion.

The emulsion may be subjected to washing by a noodle washing method or a flocculation precipitation method for removing the soluble salt. As the washing method, a method using an aromatic carbon hydride type aldehyde resin containing a sulfo group or a method using a high molecular flocculating agent G-3 or G-8 described in JP O.P.I. No. 2-7037 are cited as a particularly preferable desalting method.

In the silver halide emulsion relating to the invention, the foregoing metal salt or complex thereof and various kinds of photographic additives can be added at a process of physical ripening or after or before of chemical ripening process.

A supports usable in the light-sensitive material relating to the invention includes those described in Research Disclosure No. 17643, page 28, and No. 308119, page 1009.

Polyethylene terephthalate film is suitable for the support. The surface of the support may be subjected to provision with a subbing layer, corona discharge or UV irradiation to raise the adhesiveness of the surface with the coated layer.

The light-sensitive material is processed by an automatic processor having a process for developing, fixing, washing and drying, the process of the developing to drying is not more than 45 seconds, preferably not more than 30 seconds. In the course of the rapid processing as above-mentioned, an unevenness of development tends to be formed which is caused by continuing the development at the portion of feeding roller for transportation of the light-sensitive material from the developing tank to the fixing tank of an automatic processor. Particularly, the unevenness of the development is easily occurred when the light-sensitive material has a high swelling degree for raising suitability for rapid processing of the light-sensitive material or the anti-static property of the light-sensitive material is improved by using a surfactant. It is confirmed that the unevenness of development is formed little in a light-sensitive material containing a leucocompound, which reacts with the oxidation product of a developing agent, and metal oxide particles according to the present invention. It seems that uniformity of a surfactant and a development inhibitor on the surface or in the interior of the light-sensitive material and the regeneration of the developing agent are considerably improved in such the light-sensitive material.

EXAMPLES

The invention is described below according to examples.

Example 1

(Preparation of seed emulsion EM-A)

A seed emulsion EM-A was prepared as follows:

| | |
|---|---|
| A1 | |
| Ossein gelatin | 100 g |
| Potassium bromide | 2.05 g |
| Water to make | 11.5 l |
| B1 | |
| Ossein gelatin | 55 g |
| Potassium bromide | 65 g |
| Potassium iodide | 1.8 g |
| 0.2N sulfuric acid | 38.5 ml |
| Water to make | 2.6 l |
| C1 | |
| Ossein gelatin | 75 g |
| Potassium bromide | 950 g |
| Potassium iodide | 27 g |
| Water to make | 3.0 l |
| D1 | |
| Silver nitrate | 95 g |
| Water to make | 2.7 l |
| E1 | |
| Silver nitrate | 1410 g |
| Water to make | 3.2 l |

To Solution Al kept at 60° C. in an reaction vessel, Solutions B1 and D1 were added by a double-jet method spending 30 minutes. After that, Solutions C1 and E1 were added by a double jet-method spending 105 minutes. The stirring was carried out at a speed of 500 rpm. The flowing rates of the addition of the solutions were controlled as the grains were grown, so that new nucleus was not formed and broadening of the diameter distribution caused by Ostwald ripening was not occurred. During the addition of the solution of silver ions and the solution of halide ions, the pAg was adjusted to 8.3±0.05 using a potassium bromide solution and the pH was adjusted to 2.0±0.1 using sulfuric acid. After completion of the addition of the solutions, a desalting treatment was carried out according to a method described in JP No. 35-16096 for removing excessive salts.

According to observation by an electron microscope, it was confirmed that thus obtained emulsion was a monodispersed emulsion comprising cube-shaped tetradecahedral grains having slightly chipped corners and an average diameter of 0.27 μm and a broadness of the diameter distribution of 17%.

(Preparation of Em-1)

A monodispersed core/shell type emulsion was prepared using the seed emulsion EM-A and the following solutions.

| | |
|---|---|
| A2 | |
| Ossein gelatin | 10 g |
| Ammonia water (28%) | 28 ml |
| Glacial acetic acid | 3 ml |
| Seed emulsion EM-A | Equivalent to 0.119 moles |
| Water to make | 600 ml |
| B2 | |
| Ossein gelatin | 0.8 g |
| Potassium bromide | 5 g |
| Potassium iodide | 3 g |
| Water to make | 110 ml |
| C2 | |
| Ossein gelatin | 2 g |
| Potassium bromide | 90 g |
| Water to make | 240 ml |
| D2 | |
| Silver nitrate | 9.9 g |
| Ammonia water (28%) | 7.0 ml |
| Water to make | 110 ml |
| E2 | |
| Silver nitrate | 130 g |
| Ammonia water (28%) | 100 ml |
| Water to make | 240 ml |
| F2 | |
| Potassium bromide | 94 g |
| Water to make | 165 ml |
| G2 | |
| Silver nitrate | 9.9 g |
| Ammonia water (28%) | 7.0 ml |
| Water to make | 110 ml |

Solution A2 was stirred at 800 rpm by a stirrer while maintaining at 40° C. The pH value of Solution A2 was adjusted to 9.90 using acetic acid, and seed emulsion EM-A was dispersed in Solution A2. Then Solution G2 was added spending 7 minutes with a constant flow rate, and pAg was adjusted to 7.3. Furthermore, Solution B2 and Solution D2 were simultaneously added spending 20 minutes while maintaining the pAg at 7.3. Next, the pH and pAg were adjusted to 8.83 and 9.0, respectively, by a potassium bromide solution and acetic acid, then Solution C2 and Solution E2 were simultaneously added spending 30 minutes.

At this time, the flow rates of the solutions were increased as the adding time so that the ratio of flow rate at the time of start to that at the time of completion of the addition was 1:10. The pH value was lowered 8.83 to 8.00 proportionally to the flow rate. Solution F2 was additionally added spending 8 minutes with a constant rate after ⅔ of Solution C2 and Solution E2 were added. The pAg value was raised 9.0 to 11.0 at this time and the pH value was adjusted to 6.0 by acetic acid.

After the addition, the emulsion was subjected to a flocculation desaltation using a solution of Demol, manufactured by Kao-Atlas Co., and an aqueous solution of magnesium sulfate for removing an excess salt. Thus an emulsion having a pAg value of 8.5, a pH value of 5.85 at 40° C. and an average silver iodide content of 2 mole-% was obtained.

According to observation by the electron microscope, the emulsion was a slightly rounded tetradecahedral monodispersed core/shell type emulsion having an average grain diameter of 0.55 μm and a broadness of grain diameter distribution of 14%.

(Preparation of hexagonal tabular seed emulsion)

A hexagonal tabular seed emulsion EM-B was prepared by the following procedure.

| | |
|---|---|
| A3 | |
| Ossein gelatin | 60.2 g |
| Distilled water | 20.0 l |
| $HO—(CH_2CH_2O)_n—[CH(CH_3)CH_2O]_{17}—(CH_2CH_2O)_mH$ (n + m = 5 to 7) 10% methanol solution | 5.6 ml |
| Potassium bromide | 26.8 g |
| 10% sulfuric acid | 144 ml |
| B3 | |
| Silver nitrate | 1487.5 g |
| Distilled water to make | 3500 ml |
| C3 | |
| Potassium bromide | 1050 g |
| Distilled water to make | 3500 ml |
| D3 | |
| 1.75N potassium bromide aqueous solution | An mount necessary to control the following silver potential |

To Solution A3, 64.1 ml of Solution B3 and the same amount of Solution C3 were added to form nuclei at 35° C. by a double-jet mixing method spending 2 minutes using a mixing apparatus disclosed in JP Nos. 58-58288 and 58-58289.

After the addition of Solutions B3 and C3 was stopped, Solution A3 was heated to 60° C. spending 60 minutes. Then Solution B3 and Solution C3 were further added by a double-jet method for 50 minutes with a flow rate of 68.5 ml/minute, respectively. In this period, the silver potential $E_{Ag}$ measured by a silver ion selective electrode using a saturated silver-silver chloride electrode as a reference electrode is controlled by Solution D so as that the silver potential was kept at +6 mV. After the addition of the solutions, the pH value of the emulsion was adjusted to 6 by a 3%-solution of KOH. Just after that, the emulsion was desalted. Thus obtained emulsion was referred to Seed Emulsion EM-B. It was confirmed by the electron microscope that, in Seed Emulsion EM-B, hexagonal tabular grains having a maximum adjacent edge ratio of 1.0 to 2.0 account for not less than 90% of the total projection area of silver halide grains, and the hexagonal grains had an average thickness of 0.07 μm, an average diameter (circle equivalent diameter) of 0.5 μm and a variation coefficient of 25%.

(Preparation of silver bromide emulsion EM-2)

A tabular grain silver bromide emulsion was prepared using the following four kinds of solution.

| | |
|---|---|
| A4 | |
| Ossein gelatin | 29.4 g |
| $HO—(CH_2CH_2O)_n—[CH(CH_3)CH_2O]_{17}—(CH_2CH_2O)_mH$ (n + m = 5 to 7) 10% methanol solution | 1.25 ml |
| Seed Emulsion EM-B | Equivalent to 2.65 moles |
| Distilled water to make | 3000 ml |
| B4 | |
| 3.50N silver nitrate aqueous solution | 1760 ml |
| C4 | |
| Potassium bromide | 737 g |
| Distilled water to make | 1760 ml |

-continued

| | |
|---|---|
| D4 | |
| 1.75N potassium bromide aqueous solution | An mount necessary to control the following silver potential |

To Solution A4, Solution B4 and Solution C4 were all added spending 110 minutes at 60° C. by a double-jet mixing method using a mixing apparatus disclosed in JP No. 58-58288 for growing the seed grains. The flow rate of the solutions was controlled so that the flow rate at the completion of the addition was 3 times of that at the start of the addition. The $E_{Ag}$ value of the emulsion was adjusted to +40 mV during the addition.

After the addition of the solutions, the emulsion was desalted by the following procedure for removing an excessive salt.

1. To the emulsion adjusted to 40° C., 20 g/mole of silver halide of gelatin modified by a phenylcarbamoyl group in a substituting ratio of 90% G-3 was added as a flocculating agent and the pH value thereof was lowered to 4.30 by adding 56 wt-% of acetic acid. The solution was stood and decanted.

2. To the flocculate, 1.8 l/mole of silver halide of pure water of 40° C. was added and the mixture was stood and decanted after stirring for 10 minutes.

3. The above-mentioned procedure 2 was repeated once more,

4. Then the flocculate was dispersed at pH of 6.0 by addition of 15 g/mole of silver halide of gelatin, sodium carbonate and water, and the dispersion was made up to 450 ml/mole of silver halide.

According to the observation and determination on about 3,000 grains of thus obtained emulsion EM-2 by the electron microscope, the grains were hexagonal tabular grains having an average circle equivalent diameter of 0.59 μm, an average thickness of 0.17 μm and a variation coefficient of 24%.

(Preparation of silver chloride tabular seed emulsion)

Preparation of EM-C (silver chloride tabular seed emulsion)

| | |
|---|---|
| A5 | |
| Ossein gelatin | 37.5 g |
| Potassium iodide | 0.625 g |
| Sodium chloride | 16.5 g |
| Distilled water to make | 7500 ml |
| B5 | |
| Silver nitrate | 1500 g |
| Distilled water to make | 2500 ml |
| C5 | |
| Potassium iodide | 4 g |
| Sodium chloride | 140 g |
| Distilled water to make | 684 ml |
| D5 | |
| Sodium chloride | 375 g |
| Distilled water to make | 1816 ml |

To Solution A5 in a mixing apparatus disclosed in JP Nos. 58-58288 and 58-58289, 684 ml of Solution BS and all of Solution C5 were added spending 1 minute. The emulsion was subjected to Ostwald ripening for 20 minutes after adjusting the $E_{Ag}$ value at 149 mV. Then remnants of Solution A5 and Solution D5 were all added spending 40 minutes while maintaining the $E_{Ag}$ value at 149 mV.

The emulsion was desalted just after the addition of the solutions to prepare Seed Emulsion EM-C. It is confirmed by the electron microscopic observation that, in the emulsion, tabular grains each having (100) face as the major face thereof account for nor less than 60% of total projection area of the silver halide grains of the emulsion and the tabular grains have an average thickness of 0.07 μm, an average diameter of 0.5 μm and a variation coefficient of 25%.

(Preparation of silver chloride emulsion EM-3)

A tabular silver chloride emulsion was prepared using the following four solutions.

| | |
|---|---|
| A3 | |
| Ossein gelatin | 29.4 g |
| $HO—(CH_2CH_2O)_n—[CH(CH_3)CH_2O]_{17}—(CH_2CH_2O)_mH$ (n + m = 5 to 7) 10% methanol solution | 1.25 ml |
| Seed emulsion EM-C | Equivalent to 0.98 moles |
| Distilled water to make | 3000 ml |
| B6 | |
| 3.50N silver nitrate aqueous solution | 2240 ml |
| C6 | |
| Sodium chloride | 455 g |
| Distilled water to make | 2240 ml |
| D6 | |
| 1.75N sodium chloride aqueous solution | An mount necessary to control the following silver potential |

Solution B6 and Solution C6 were all added to Solution A6 spending 110 minutes at 60° C. by a double-jet mixing method using a mixing apparatus disclosed in JP No. 58-58288 for growing the seed grains. The flow rates of the solutions were controlled so that the flow rate at the completion of the addition was 3 times of that at the start of the addition. The $E_{ag}$ value was controlled at +120 mV by Solution D6 during the addition. After the addition, the emulsion was subjected to a flocculation desalting in the same manner as in EM-1 for removing an excessive salt.

According to the observation and determination of about 3,000 grains of thus obtained emulsion EM-3 by the electron microscope, tabular grains having a (100) face as the major face thereof accounted for not less than 80% of the total projection area of the silver halide grains contained in the emulsion. The tabular grains had an average diameter of 1.17 μm, an average thickness of 0.12 μm and a variation coefficient of 24%.

(Preparation of $AgBr_{0.45}Cl_{0.55}$ tabular emulsion EM-4)

A tabular silver chlorobromide emulsion ME-4 having a silver bromide content of 45 mole-% was prepared in the same manner as in EM-3 except that 473 g of potassium bromide was added to Solution C6 and the silver potential during addition of Solutions B6 and C6 was maintained at +100 mV.

According to the observation and determination of about 3,000 grains of thus obtained emulsion EM-4 by the electron microscope, tabular grains having a (100) face as the major face thereof accounted for not less than 80% of the total projection area of the silver halide grains of the emulsion. The tabular grains had an average diameter of 1.17 μm, an average thickness of 0.12 μm and a variation coefficient of 24%.

(Preparation of silver iodide fine grain)

| | |
|---|---|
| A7 | |
| Ossein gelatin | 100 g |
| Potassium iodide | 8.5 g |
| Distilled water to make | 2000 ml |
| B7 | |
| Silver nitrate | 360 g |
| Distilled water to make | 605 ml |
| C7 | |
| Potassium iodide | 352 g |
| Distilled water to make | 605 ml |

To Solution A7 in a reaction vessel, Solution B7 and Solution C7 were added spending 30 minutes with a constant flow rate while stirring at 40° C. The pAg value was kept at 13.5 by an ordinary pAg controlling means during the addition of the solutions. Thus obtained silver iodide is a mixture of β-AgI and γ-AgI having an average diameter of 0.06 μm. The emulsion was referred to "silver iodide fine grain emulsion".

(Preparation of solid dispersion particles of spectral sensitizing dye)

The following spectral sensitizing dyes (A) and (B) were added in an ratio of 100:1 to water previously heated to 27° C. and stirred for 30 to 120 minutes by a high-speed stirrer or dissolver at a speed of 3,500 rpm to prepare a dispersion of solid particles of the spectral sensitizing dyes. The dispersion was adjusted so that the concentration of the sensitizing dye (a) was 2%.

Sensitizing dye (A): sodium salt of 5,5-dichloro-9-ethyl-3,3'-di-(sulfopropyl)oxacarbocyanine anhydride Sensitizing dye (B): sodium salt of 5,5'-di-(butoxycarbonyl)-1,1'-diethyl-3,3'-di-(4-sulfobutyl)benzimidazolocarbocyanine anhydride (Selenium sensitization)

The emulsions EM-1 through EM-4 were each optically and chemically sensitized by the following procedures.

The emulsion was heated to 60° C. and the foregoing dispersion of solid particles of sensitizing dyes was added so that the amount of sensitizing dye (A) was 460 mg per mole of silver. Then the emulsion was chemically sensitized optimally after addition of ammonium thiocyanate, potassium chloroaurate, sodium thiosulfate each in an amount of $7.0\times10^{-4}$ moles per mole of silver, respectively, and $3.0\times10^{-6}$ moles per mole of silver of triphenylphosphine selenide. The emulsion was stabilized by $3\times10^{-2}$ moles of 4-hydroxy-6-methyl-1,3,3a,7-tetraazaindene (TAI) after addition of $3\times10^{-3}$ moles per mol of silver of the foregoing silver iodide fine grain emulsion.

The later-mentioned additives were added to thus sensitized emulsions EM-1 through EM-4 to prepared coating liquids for emulsion layer. A protective layer coating solution was prepared at the same time.

<Preparation of electric conductive particle>

(Dispersion of electric conductive particle Pi)

In 2000 ml of water, 65 g of stannic chloride hydrate was dissolved to prepare a uniform solution. A precipitation was formed by boiling the solution. The precipitation was separated by decantation and washed repeatedly by distilled water. The washing was repeated until chloride ion reaction was not found by addition of a drop of a silver nitrate solution to water used for washing the precipitation. The precipitation was to 1000 ml of water and dispersed and the dispersion was made up to 2000 ml in total. The dispersion was heated after addition of 40 cc of 30% ammonia water, thus $SnO_2$ sol liquid was formed.

When the sol liquid was used for coating liquid, the sol liquid was concentrated to about 8% while blowing ammonia gas. The volume intrinsic resistivity of the particles contained in the sol liquid was defined by a value measured by a four terminal method with respect to a layer formed by the sol liquid on a silica glass plate. The volume intrinsic resistivity thus measured was $3.4\times10^4\Omega\cdot$cm.

(Dispersion of electric conductive particle P2)

In 2000 ml of water, 65 g of stannic chloride hydrate and 1.0 g of antimony trichloride was dissolved to prepare a uniform solution. A coprecipitate was formed by boiling the solution. The precipitation was separated by decantation and washed repeatedly by distilled water. The washing was repeated until chloride ion reaction was not found by addition of a drop of a silver nitrate solution to water used for washing the precipitation. The precipitation was to 1000 ml of water and dispersed and the dispersion was made up to 2000 cc in total. The dispersion was heated after addition of 40 ml of 30% ammonia water, thus $SnO_2$ sol liquid was formed.

The sol liquid thus obtained was sprayed into an electric furnace heated at 400 C. to form an electric conductive powder. The intrinsic volume resistivity of the electric conductive powder in a form of tablet measured by the four terminal method was $1.5\times10^1\ \Omega\cdot$cm. The tablet was formed by tableting the electric conductive powder by a tableting machine.

The electric conductive powder was dispersed in ammonia water having a pH value of 10 so that the concentration was 8% by weight.

(Preparation of support of silver halide photographic light-sensitive material)

(Support 1)

A biaxially extended and thermally fixed polyethylene terephthalate film having a thickness of 175 $\mu$m and a blue tinted density of 0.15 was subjected to corona discharge treatment with 8 W min/m$^2$ on both sides. On a side of the film, the following subbing liquid B-1 was coated according to the description in JP O.P.I. No. 59-19941 and dried for 1 minute at 100° C. so as to form a subbing layer B-1 having a dry thickness of 0.8 $\mu$m. Then the following subbing liquid B-2 was coated on the side of the polyethylene terephthalate film opposite to the side on which the subbing layer B-1 was provided, according to the description in JP O.P.I. No. 59-77439 to form a subbing layer B-2-1 and dried at 110° C. for 1 minutes.

First subbing layer

| <Subbing layer coating liquid B-1> | |
|---|---|
| Latex of copolymer of 30 wt-% of butyl acrylate, 20 wt-% of t-butyl acrylate, 25 wt-% of styrene and 25 wt-% of hydroxyethyl acrylate (solid content: 30%) | 270 g |
| Compound A | 0.6 g |
| Hexamethylene-1,6-bis(ethyleneurea) | 0.8 g |
| Water to make | 1 l |
| <Subbing layer coating liquid B-2-1> | |
| Latex of 40 wt-% of butyl acrylate, 20 wt-% of styrene and 40 wt-% of glycidil acrylate (solid content: 30%) | 23 g |
| Electric conductive particle P1 dispersion | 415 g |
| Polyethylene glycol (molecular weight: 600) | 0.12 g |
| Water | 568 g |

Second subbing layer

Corona discharge of 8 W·min/m$^2$ was applied on the above-mentioned subbing layers B-1 and B-2-1, and the following subbing liquid B-3 was coated on the subbing layers so that the dry thickness was 0.1 $\mu$m, and dried for 1 minute at 100° C.

| <Subbing layer liquid B-3> | |
|---|---|
| Gelatin | 10 g |
| Compound A | 0.4 g |
| Compound B | 0.1 g |
| Silica particles having an average diameter of 3 $\mu$m | 0.1 g |
| Water to make | 1 l |

Compound A

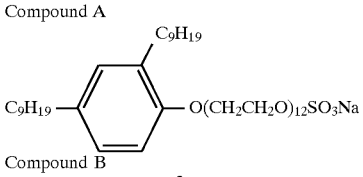

Compound B

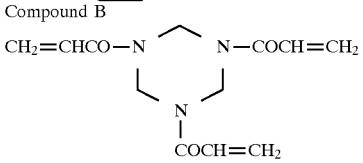

(Support 2)

Support 2 was prepared in the same manner as in Support 1 except that subbing coating liquid B-2-2 was used in place of subbing coating liquid B-2-1.

| <Subbing layer coating liquid B-2-2> | |
|---|---|
| Latex of copolymer of 40 wt-% butyl acrylate, 20 wt-% of styrene and 40 wt-% of glycidyl acrylate (solid content: 30%) | 23 g |
| Electric conductive particle dispersion 2 | 760 g |
| Polyethylene glycol (molecular weight: 600) | 1.65 g |
| Water | 700 g |

(Support 3)

Support 3 was prepared in the same manner as in Support 1 except that the following subbing layer coating liquid B-3-1 was coated in place of subbing layer coating liquid B-2-2.

| <Subbing layer coating liquid B-3-1> | |
|---|---|
| Latex of copolymer of 40 wt-% butyl acrylate, 20 wt-% of styrene and 40 wt-% of glycidyl acrylate (solid content: 30%) | 23 g |
| Vanadium pentaoxide particle dispersion | 760 g |
| Polyethylene glycol (molecular weight: 600) | 1.65 g |
| Water | 700 g |

The above-mentioned vanadium pentaoxide dispersion was prepared according to the description of Example 3 in U.S. Pat. No. 4,203,769.

(Comparative support)

A polyethylene terephthalate film base for X-ray film having a blue tinted density of 0.160 and a thickness 175 $\mu$m was used a comparative support, which was coated with a suspension of a copolymer composed of three kind of monomer of 50 wt-% of glycidyl methacrylate, 10 wt-% of methyl acrylate and 40 wt-% of butyl methacrylate.

(Preparation of sample)

On the both sides of the above-mentioned support, the following cross-over cutting layer, emulsion layer, inter layer and protective layer were uniformly coated in this order and dried to prepare samples. The layers were simultaneously coated so that the coating amount were as follows.

First layer (cross-over cutting layer)

| | |
|---|---|
| First layer (cross-over cutting layer) | |
| Solid particle dispersion of Dye (AH) | 20 mg/m$^2$ |
| Gelatin | 0.2 g/m$^2$ |
| Sodium dodecylbenzenesulfonate | 5 mg/m$^2$ |
| Compound I | 5 mg/m$^2$ |
| Sodium salt of 2,4-dichloro-6-hydroxy-1,3,5-triazine | 5 mg/m$^2$ |
| Colloidal silica (average diameter: 0.014 $\mu$m) | 10 mg/m$^2$ |
| Second layer (emulsion layer) | |
| The following additives were added to each of the foregoing emulsions. | |
| Compound G | 0.5 mg/m$^2$ |
| 2,6-bis(hydroxyamino)-4-diethylamino-1,3,5-triazine | 5 mg/m$^2$ |
| t-butyl-catechol | 130 mg/m$^2$ |
| Polyvinypyrrolidone (molecular weight: 10,000) | 35 mg/m$^2$ |
| Styrene-maleic anhydrous copolymer | 80 mg/m$^2$ |
| Sodium polystyrenesulfonate | 80 mg/m$^2$ |
| Trimethylolpropane | 350 mg/m$^2$ |
| Diethylene glycol | 50 mg/m$^2$ |
| Leucocompound | See Table 1 |
| Nitrophenyl-triphenyl-phosphonium chloride | 20 mg/m$^2$ |
| Ammonium 1,3-dihydroxybenzene-4-sulfonate | 500 mg/m$^2$ |
| Sodium mercaptobenzimidazole-5-sulfonate | 5 mg/m$^2$ |
| Compound H | 0.5 mg/m$^2$ |
| n-$C_4H_9OCH_2CH(OH)CH_2N(CH_2COOH)_2$ | 350 mg/m$^2$ |
| Compound M | 5 mg/m$^2$ |
| Compound N | 5 mg/m$^2$ |
| Colloidal silica | 0.5 mg/m$^2$ |
| Latex L | 0.2 mg/m$^2$ |
| Dextrin (average molecular weight: 1000) | 0.2 g/m$^2$ |
| Dextran (average molecular weight: 40000) | 0.1 g/m$^2$ |
| Gelatin was controlled so that the coating amount was 1.0 g/m$^2$ | |
| Third layer (interlayer) | |
| Gelatin | 0.4 g/m$^2$ |
| Formaldehyde | 10 mg/m$^2$ |
| Sodium salt of 2,4-dichloro-6-hydroxy-1,3,5-triazine | 5 mg/m$^2$ |
| Bis-vinylsulfonylmethyl ether | 18 mg/m$^2$ |
| Latex L | 0.05 g/m$^2$ |
| Sodium polyacrylate | 10 mg/m$^2$ |
| Compound S-1 | 3 mg/m$^2$ |
| Compound K | 5 mg/m$^2$ |
| Compound B | 1 mg/m$^2$ |
| Fourth layer (protective layer) | |
| Gelatin | 0.4 g/m$^2$ |
| Matting agent of polymethyl methacrylate (area average diameter: 7.0 $\mu$m) | 50 mg/m$^2$ |
| Formaldehyde | 10 mg/m$^2$ |
| Sodium salt of 2,4-dichloro-6-hydroxy-1,3,5-triazine | 5 mg/m$^2$ |
| Bis-vinylsulfonylmethyl ether | 18 mg/m$^2$ |
| Latex L | 0.1 g/m$^2$ |
| Polyacrylamide (average molecular weight: 10000) | 0.05 g/m$^2$ |
| Sodium polyacrylate | 20 mg/m$^2$ |
| Polysiloxane SI | 20 mg/m$^2$ |
| Compound I | 12 mg/m$^2$ |
| Compound J | 2 mg/m$^2$ |
| Compound S-1 | 7 mg/m$^2$ |
| Compound K | 15 mg/m$^2$ |
| Compound O | 50 mg/m$^2$ |
| Compound S-2 | 5 mg/m$^2$ |
| $C_9F_{19}$—O—$(CH_2CH_2O)_{11}$—H | 3 mg/m$^2$ |
| Compound S-3 | 2 mg/m$^2$ |
| Compound S-4 | 1 mg/m$^2$ |
| Hardener B | 1.5 mg/m$^2$ |

The mounts of the materials were those on one side of the sample. The coating amount of silver is controlled so as to be that shown in Table 1.

Compound G

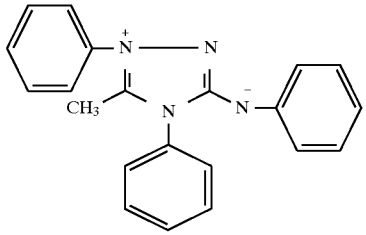

Compound H

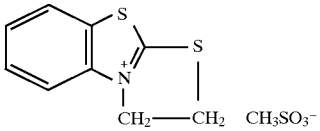

Compound I

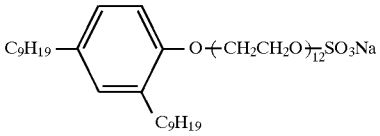

Compound J

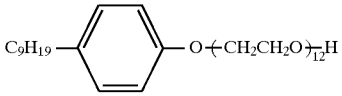

Compound K

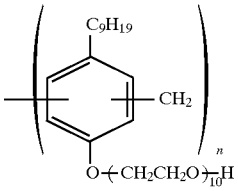

(Mixture of ones having n of 2 to 5)

Compound S-1

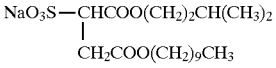

Compound S-2

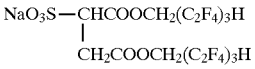

Latex L

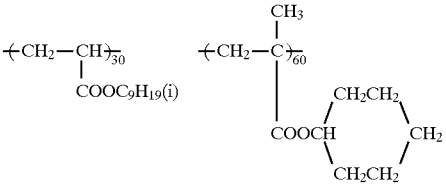

-continued

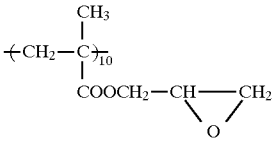

Polysiloxane S1

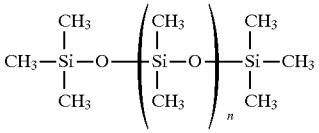

Solid fine particle dispersed dye AH

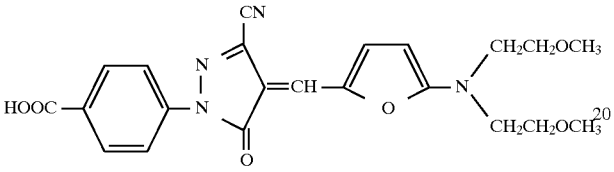

Compound O $C_{11}H_{23}CONH(CH_2CH_2O)_5H$

Compound M

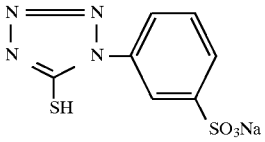

Compound N

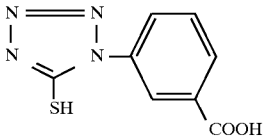

Hardner A

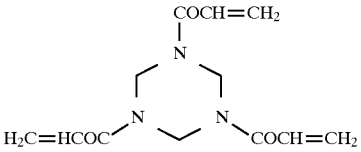

Hardner B

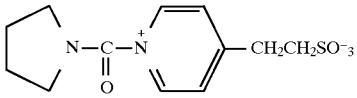

S-3

$C_8F_{17}SO_2N(C_3H_7)(CH_2CH_2O)_{15}H$

S-4

$C_8F_{17}SO_2N(C_3H_7)(CH_2CH_2O)_4(CH_2)_4SO_3Na$ (Evaluation of anti-static property: ash adhesion test)

The emulsion side of a processed sample was rubbed by a rubber roller under a condition of 23° C. and 20% RH and the sample was brought closer to ash of cigarette. Adhesion of the ash on the film was evaluated according to the following ranks.

4: The ash was not adhered when the distance of the film to the ash was less than 1 cm.
3: The ash was adhered when the distance was 1 to 4 cm.
2: The ash was adhered when the distance was 4 to 10 cm.
1: The ash was adhered when the distance was more than 10 cm.

(Evaluation of unevenness of development)

The samples were processed using an automatic processor SRX-503 manufactured by Konica Corp. which is modified so that the processing time was as follows, and a processing solution SR-DF, manufactured by Konica Corporation.

The sample of a large-square size (35.6 cm×35.6 cm) was uniformly exposed to X-ray so as to form a density of 1.0, and 50 sheets of the sample were continuously processed. The processed sample was observed on a viewer and the unevenness of development observed was evaluated according to the following four ranks. The replenishing amounts of the developing and fixing solutions were each 125 ml/m$^2$.

Developing time: 8 seconds (developing temperature: 35° C.)
Fixing time: 6.2 seconds
Washing time: 4 seconds
Interval of washing to drying (squeeze): 3.2 seconds
Drying time: 8.6 seconds
Total processing time: 30 seconds The drying was carried out by a heat roller having a surface temperature of 60° C. The heating roller was a aluminum roller coated with Teflon and a halogen heater was used as a heat source.

4: No unevenness was observed
3: Unevenness was slightly observed
2: Unevenness was apparently observed
1: Unevenness was observed overall (Evaluation of tone of silver image)

The film sample of a large-square size (35.6 cm×35.6 cm) were uniformly exposed to X-ray so as to form a density of 1.2, and process in the same manner as above-mentioned. The processed sample was stood under a condition of 50° C. and 80% RH for 7 days and observed on a viewer. The tone of silver image visually evaluated.

4: Pure black
3: Slightly reddish black
2: Reddish black
1: Yellowish black

Results thus obtained are listed in Table 1.

TABLE 1

| Sample No. | Emulsion No. | Suppot No. | Leuco-compound No. | Leuco-compound Amount (mg/m²) | Gelatin amount in emulsion layer (mg/m²) | Gelatin amount in emulsion layer (%) | Silver halide Amount g/m² per side | Development Unevenness | Silver image tone | Anti-static property | Note |
|---|---|---|---|---|---|---|---|---|---|---|---|
| 1 | EM-2 | 1 | — | — | 2.5 | 43 | 1.8 | 1 | 1 | 2 | Comp. |
| 2 | EM-2 | 1 | 8 | 20 | 2.5 | 43 | 1.8 | 3 | 2 | 3 | Inv. |
| 3 | EM-2 | 1 | 8 | 20 | 2.5 | 43 | 1.4 | 3 | 4 | 3 | Inv. |
| 4 | EM-2 | 1 | 8 | 20 | 2.0 | 38 | 1.4 | 4 | 4 | 4 | Inv. |
| 5 | EM-2 | 1 | — | — | 1.5 | 31 | 1.4 | 2 | 1 | 4 | Comp. |
| 6 | EM-2 | 1 | 8 | 20 | 1.5 | 31 | 1.4 | 4 | 4 | 4 | Inv. |
| 7 | EM-2 | 1 | 9 | 20 | 1.5 | 31 | 1.4 | 4 | 4 | 4 | Inv. |
| 8 | EM-2 | 2 | 8 | 20 | 1.5 | 31 | 1.4 | 4 | 4 | 4 | Inv. |
| 9 | EM-3 | 1 | 8 | 20 | 1.5 | 31 | 1.4 | 4 | 4 | 4 | Inv. |
| 10 | EM-2 | 1 | 8 | 20 | 1.0 | 13 | 1.2 | 4 | 4 | 4 | Inv. |
| 11 | EM-1 | 1 | 8 | 15 | 1.5 | 31 | 1.4 | 4 | 4 | 4 | Inv. |
| 12 | EM-4 | 1 | 8 | 25 | 1.5 | 31 | 1.4 | 4 | 4 | 4 | Inv. |
| 13 | EM-2 | 3 | 8 | 20 | 1.5 | 31 | 1.4 | 4 | 4 | 4 | Inv. |
| 14 | EM-4 | 3 | 40 | 20 | 1.5 | 31 | 1.4 | 4 | 4 | 4 | Inv. |
| 15 | EM-2 | Comp. | 8 | 20 | 1.5 | 31 | 1.4 | 4 | 2 | 1 | Comp. |

It is obvious in the results in Table 1 that The samples according to the invention are excellent in the anti-static property and give image with pure black tone of silver image.

What is claimed is:

1. A silver halide photographic light-sensitive material comprising a transparent support having thereon an electrically conductive layer, a first hydrophilic colloid layer comprising a silver halide emulsion layer, and optionally at least one additional hydrophilic colloid layer, wherein said electrically conductive layer contains colloidal particles of a metal oxide, and said first hydrophilic layer or at least one said additional hydrophilic layer contains a leuco compound of blue dye.

2. The light-sensitive material of claim 1, wherein said leucocompound of blue dye is a compound represented by Formula 1;

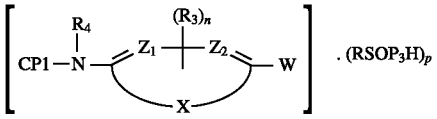

Formula 1 wherein W is —$NR_1R_2$, —OH or —OZ, in which $R_1$ and $R_2$ are each an alkyl group or an aryl group and Z is an alkali metal atom or quaternary ammonium ion, $R_3$ is a hydrogen atom, a halogen atom or a monovalent substituent, n is an integer of 1 to 3, $Z_1$ and $Z_2$ are each a nitrogen atom or =C($R_3$)—, and X is a group of atoms necessary to form a 5- or 6-member aromatic heterocyclic ring together with $Z_1$, $Z_2$ and the carbon atoms adjoin with $Z_1$ and $Z_2$, respectively, $R_4$ is a hydrogen atom, an acyl group, a sulfonyl group, a carbamoyl group, a sulfo group, a sulfamoyl group, an alkoxycarbonyl group, or an arylcarbonyl group, R is an aliphatic group or an aromatic group, p is an integer of 0 to 2, and CP1 is one of the following groups;

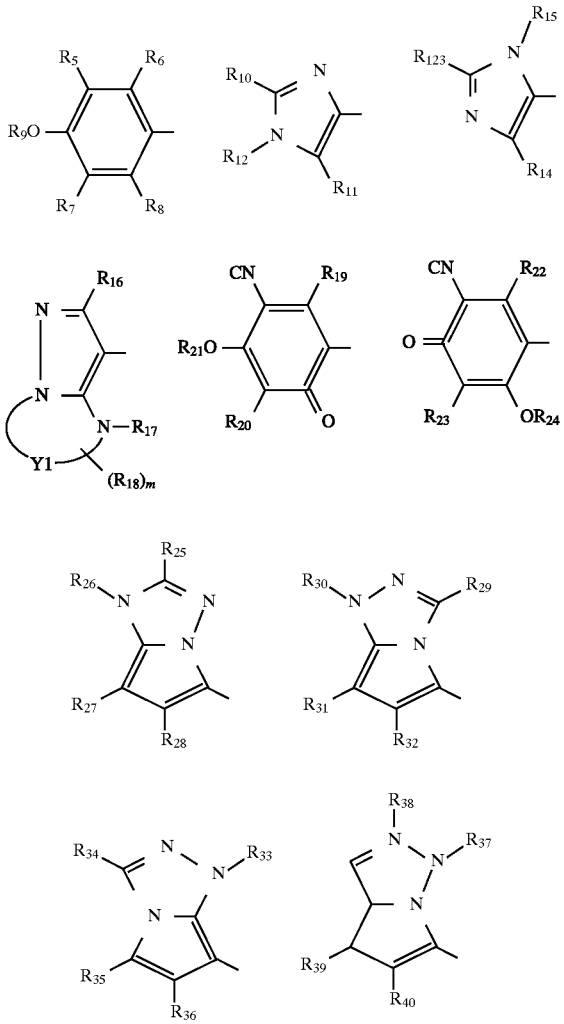

-continued

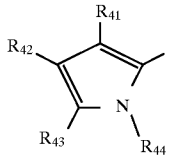

wherein $R_5$ through $R_8$ are each a hydrogen atom, a halogen atom or a group capable of being a substituent of the benzene ring; $R_5$ and $R_6$, or $R_7$ and $R_8$ may form a ring by bonding with together; $R_9$ is synonymous with $R_4$. $R_{10}$ and $R_{11}$ are each an alkyl group, an aryl group or a heterocyclic group; $R_{12}$ is the synonymous with $R_4$; $R_{13}$ and $R_{14}$ are synonymous with $R_{10}$ and $R_{11}$; $R_{15}$ is synonymous with $R_{12}$; $R_{16}$ is an alkyl group, an aryl group, a sulfonyl group, a trifluoromethyl group, a carboxyl group, an aryloxycarbonyl group, an alkoxycarbonyl group, a carbonyl group or a cyano group; $R_{17}$ is synonymous with $R_4$; $R_{18}$ is synonymous with $R_3$; m is an integer of 1 to 3; Y1 is a group of atoms necessary to form a single or condensed nitrogen containing 5- or 6-member heterocyclic ring together with the two nitrogen atoms; $R_{19}$ and $R_{20}$ are each an alkyl group or an aryl group; $R_{21}$ is synonymous with $R_4$; $R_{22}$ and $_{23}$ are synonymous with $R_{19}$ and $R_{20}$; $R_{24}$ is synonymous with $R_{21}$; $R_{25}$, $R_{27}$ and $R_{28}$ are each a hydrogen atom or a substituent; $R_{26}$ is synonymous with $R_4$; $R_{29}$, $R_{31}$ and $R_{32}$ are synonymous with $R_{25}$, $R_{27}$ and $R_{28}$. $R_{30}$ is synonymous with $R_{26}$; $R_{30}$ is synonymous with $R_{26}$; $R_{34}$, $R_{35}$ and $R_{36}$ are synonymous with $R_{25}$, $R_{27}$ and $R_{28}$; $R_{33}$ is synonymous with $R_{26}$; $R_{38}$, $R_{35}$ and $R_{40}$ are synonymous with $R_{25}$, $R_{27}$ and $R_{28}$; $R_{37}$ is synonymous with $R_{26}$; $R_{38}$, $R_41$, $R_{42}$ and $R_{43}$ are synonymous with $R_{25}$, $R_{27}$ and $R_{28}$; R44 is synonymous with $R_{26}$.

3. The light-sensitive material of claim 2, wherein said leucocompound represented by Formula 1 is a leucocompound represented by the following Formula 2;

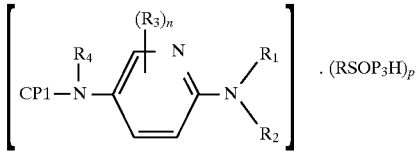

Formula 2 wherein $R_1$, $R_2$, $R_3$, $R_4$, CP1, n, R, and p are each the same as $R_1$, $R_2$, $R_3$, $R_4$, CP1, n, R, and p, respectively, defined in Formula 1.

4. The light-sensitive material of claim 1, wherein said metal oxide is ZnO, $TiO_2$ or $SnO_2$.

5. The light-sensitive material of claim 1, wherein the volumetric content of said metal oxide in said electrically conductive layer is within the range of from 10% to 70%.

6. The light-sensitive material of claim 1, wherein said leucocompound is the leucocompound of an indoaniline dye, an indamine dye, a triphenylmethane dye, a triarylmethane dye, a styryl dye, an N-acyloxazine dye, an N-acylthiazine dye, an acyldiazine dye or a xanthene dye.

7. The light-sensitive material of claim 1, wherein the amount of said leucocompound is 5 mg/$M^2$ to 300 mg/$M^2$.

8. The light-sensitive material of claim 1, wherein said leucocompound is contained in said silver halide emulsion layer.

9. The light-sensitive material of claim 1, wherein the coating amount of said silver halide emulsion layer is 0.5 to 1.5 g/$m^2$ in terms of silver and the amount of gelatin contained in said silver halide emulsion layer is 10% to 40% by weight of the total mount of binder contained in said hydrophilic colloid layer.

* * * * *